United States Patent [19]

Wilhelm

[11] 4,358,987

[45] Nov. 16, 1982

[54] SEMIAUTOMATIC HAND GUN HAVING AN ELONGATED TAKE DOWN PIN

[75] Inventor: Gary Wilhelm, Hamden, Conn.

[73] Assignee: Llama Gabilondo y. Cia. S.A., Spain

[21] Appl. No.: 174,016

[22] Filed: Jul. 31, 1980

Related U.S. Application Data

[62] Division of Ser. No. 951,967, Oct. 20, 1978, Pat. No. 4,275,640.

[51] Int. Cl.[3] ..... F41C 5/06

[52] U.S. Cl. ..... 89/196; 42/75 B

[58] Field of Search ..... 42/75 B; 89/163, 195, 89/196

[56] References Cited

U.S. PATENT DOCUMENTS 2,664,786 1/1954 Gvisasola ..... 89/163

3,207,037 9/1965 Pachmayr et al. ..... 89/196

*Primary Examiner*—Stephen C. Bentley

*Attorney, Agent, or Firm*—Fishman and Van Kirk

[57] ABSTRACT

A semiautomatic hand gun having a unique take down assembly which allows the slide assembly to be detachably secured to the frame. This take down mechanism comprises a pin which may be removed without tools and which is captured in a disengaged position to prevent loss.

5 Claims, 29 Drawing Figures

14
15
47
27
26
21
15
26
47
103
100
113
47
49
48
15
13
14
12
10
11
17
16
19
20
21
22
25
101
24
23
26
122
500

SEMIAUTOMATIC HAND GUN HAVING AN ELONGATED TAKE DOWN PIN

CROSS-REFERENCE TO RELATED APPLICATION

This is a division of U.S. patent application Ser. No. 951,967, filed Oct. 20, 1978, now U.S. Pat. No. 4,275,640.

BACKGROUND OF THE INVENTION (1) Field of the Invention

The present invention relates to guns. More particularly, the present invention relates to semiautomatic hand guns.

(2) Description of the Prior Art

In the prior art the disassembly of the slide assembly from the frame assembly of a hand gun, for purposes of cleaning and lubrication for example, has typically required tools and has often resulted parts of the gun becoming lost whereby reassembly was rendered impossible. Additionally, since the slide assembly is typically connected to the frame assembly by means of a pin, there has been an ever present danger that the forces to which the pin was subjected during movement of the slide assembly relative to the frame assembly would result in either the bending of the pin, thereby preventing diassembly, or the actual breakage thereof. Thus, there has been a long standing desire in the art to provide means whereby a weapon could be taken down, i.e., the slide assembly disassemblied from the frame assembly, without tools, without any significant danger of loss of parts and without sacrificing the requisite strength of the mechanism which couples the slide assembly to the frame assembly.

SUMMARY OF THE INVENTION

The gun of the present invention provides a unique take down assembly which allows for the slide assembly to be detachably secured to the frame assembly. The barrel includes at the rear end thereof a camming lug which extends from the slide assembly downwardly into the interior of the frame assembly of the gun. The camming lug includes an aperture which defines a camming surface. As will be described hereinafter, the camming surface functions to move the barrel in and out of the firing position. The aperture in the camming lug also forms part of the take down assembly.

The frame of the gun includes an aperture which extends through one side of the frame into the interior of the frame. The apertures in the frame and the camming lug are in alignment. A take down pin is releasably positioned within the apertures to retain the slide assembly with respect to the frame assembly.

The take down pin is releasably secured to the frame assembly by an elongated take down pin lock bolt. The lock bolt is a generally flat rectangularly shaped part which is slidable with respect to the frame and which is biased toward the front of the gun. The portion of the lock bolt which is adjacent the apertures in the frame and the barrel defines a locking surface or edge which engages a detent on the take down pin.

The take down pin has a generally elongated shape and has a length sufficient to span the width of the interior of the frame and to be engaged by both walls of the frame. One end of the pin includes a locking groove in which the locking surface or edge of the lock bolt is positioned. In order to remove the take down pin, the lock bolt is manually moved toward the rear of the gun to disengage the lock surface with the locking groove. The take down pin may then be manually withdrawn from the gun. The slide assembly may be then removed from the frame assembly.

Figure 20:
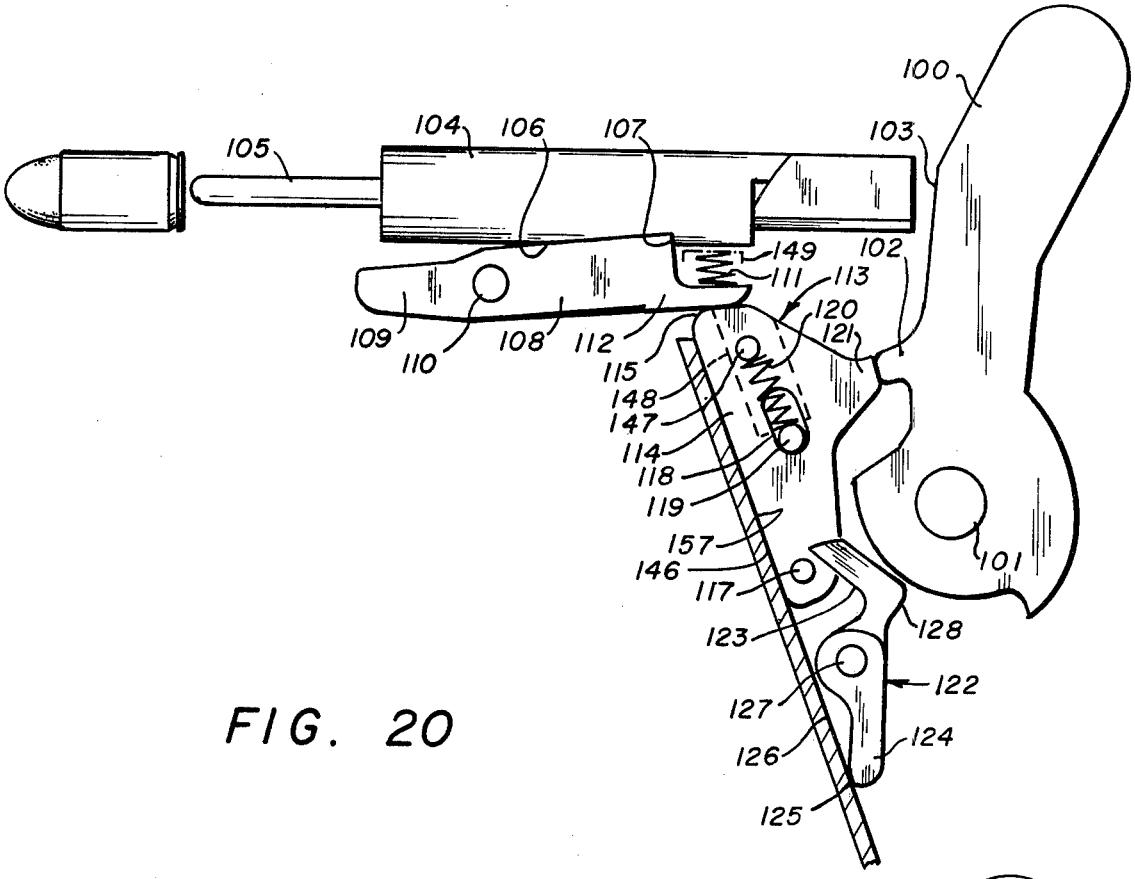
Figure 21:
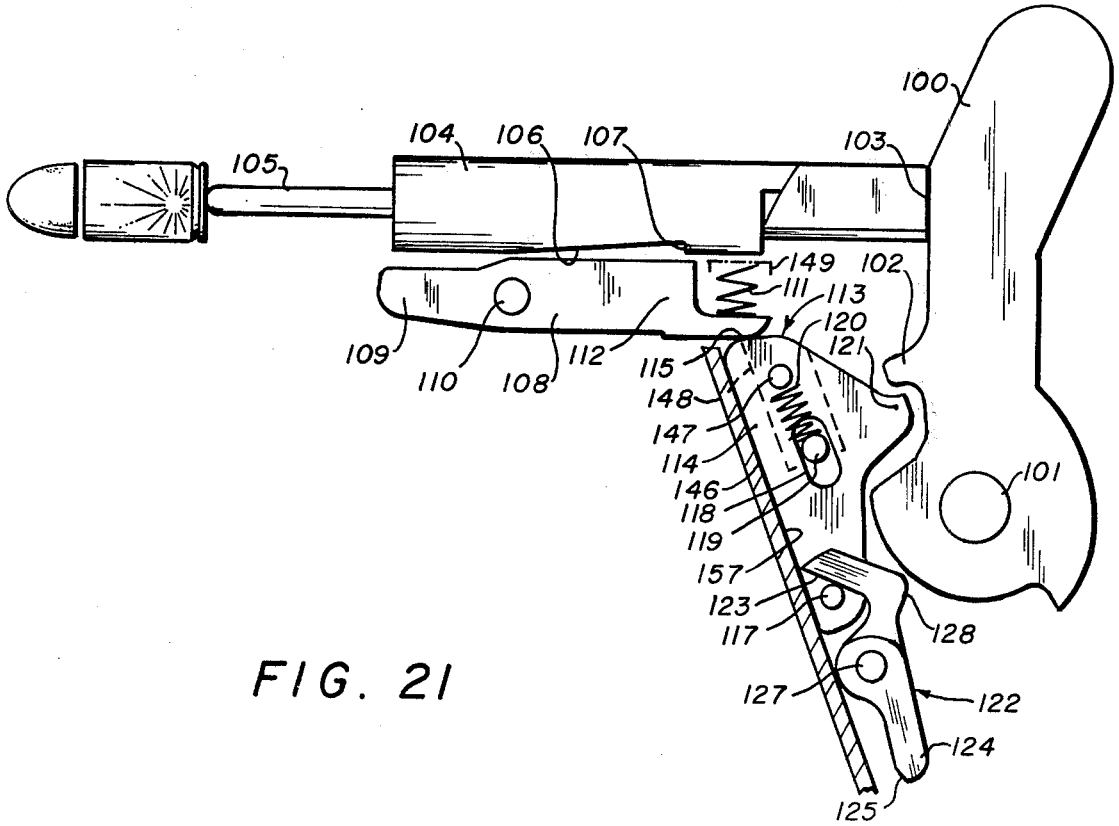
Figure 22:
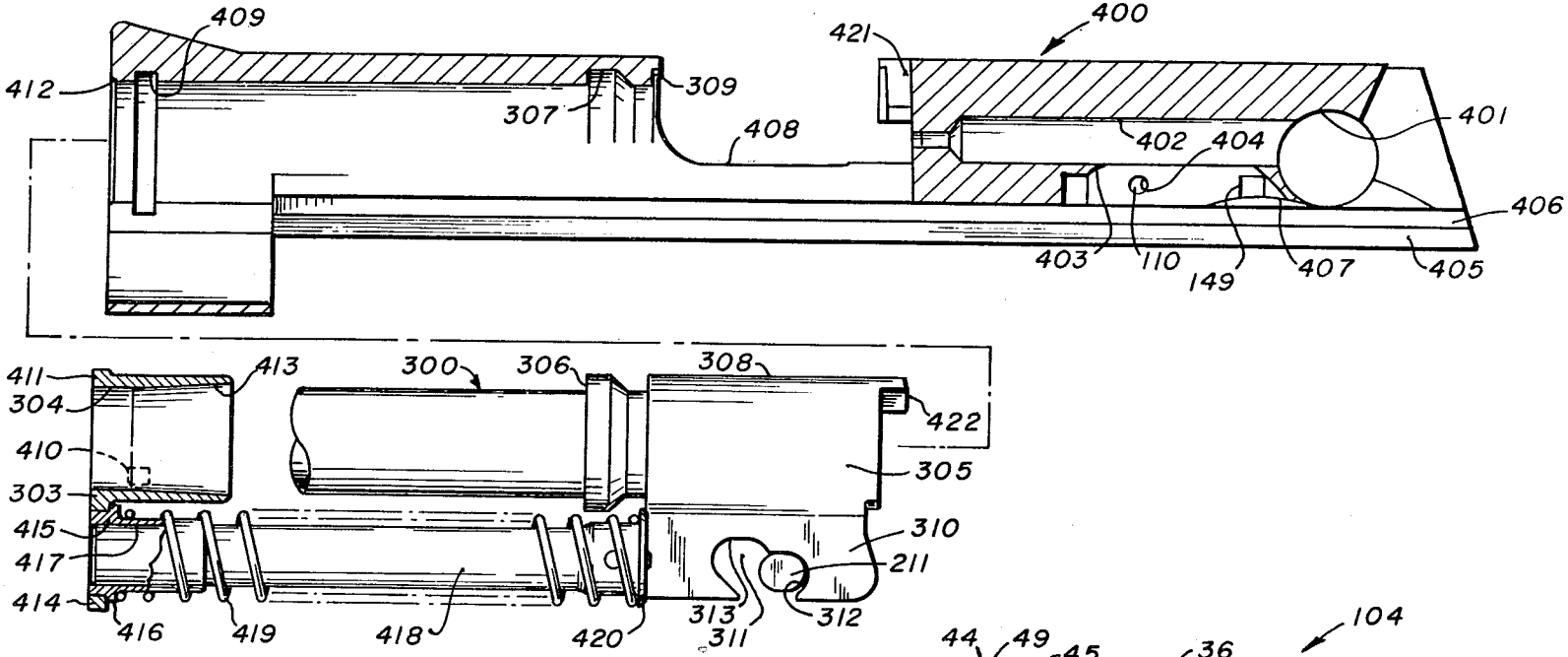
Figure 23:
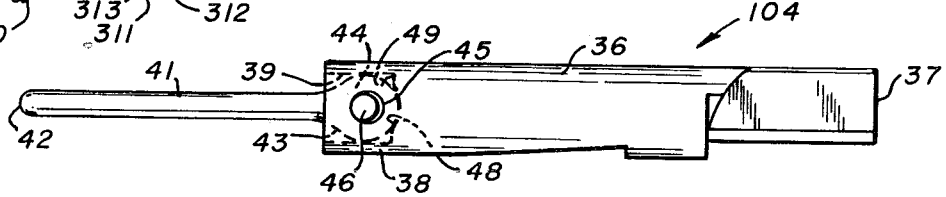
Figure 24:
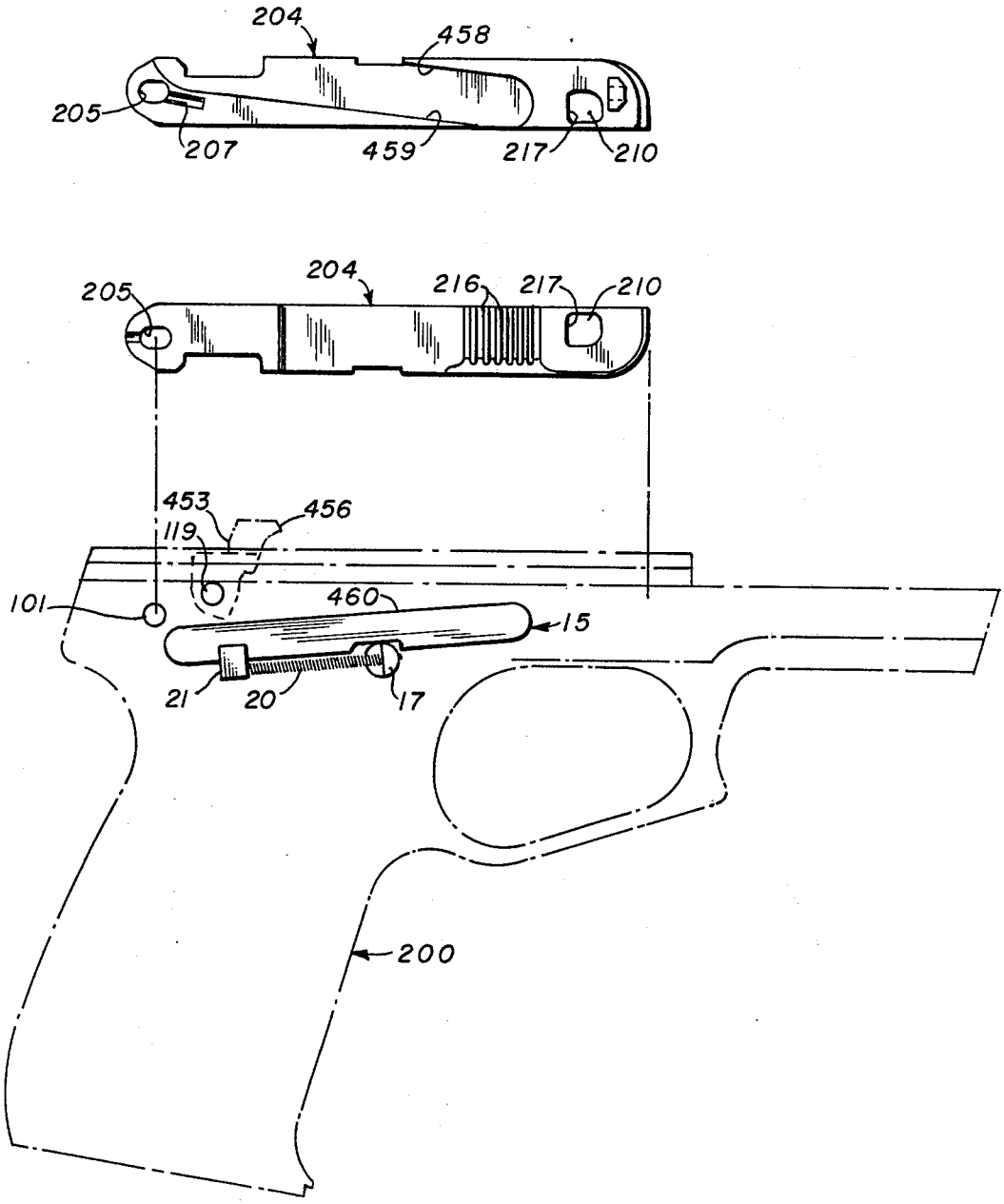
Figure 25:
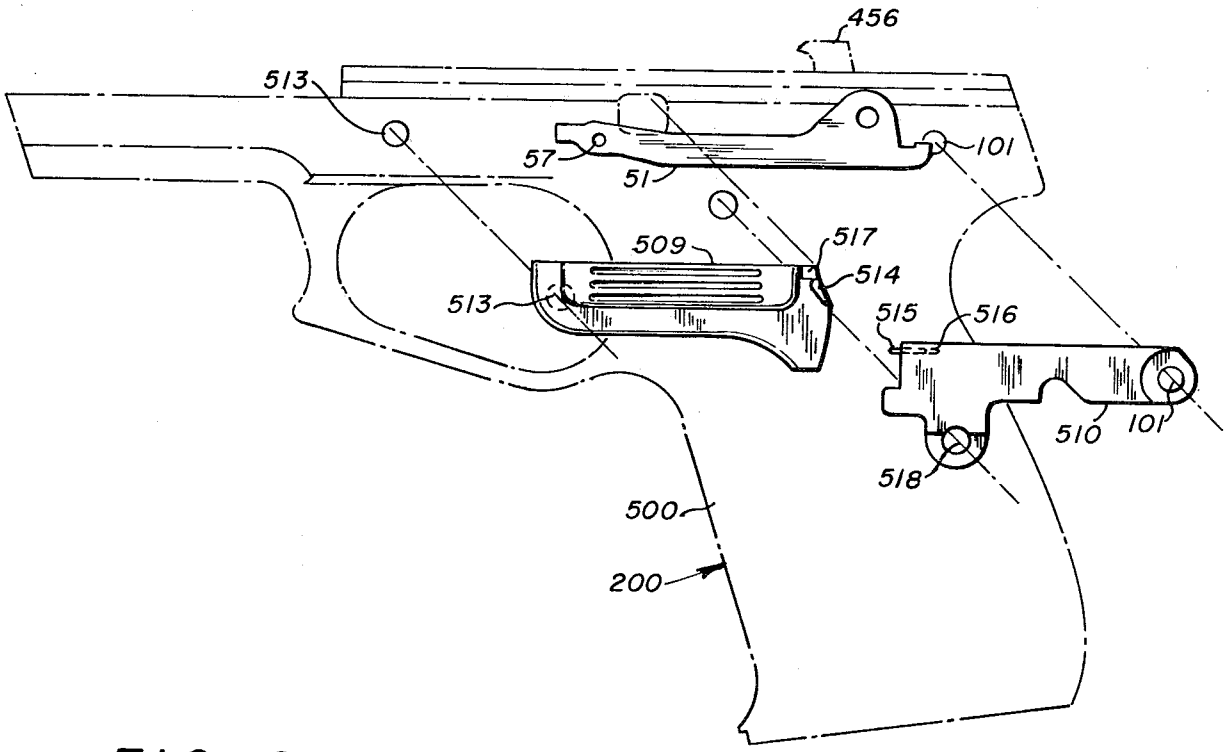
Figure 27:
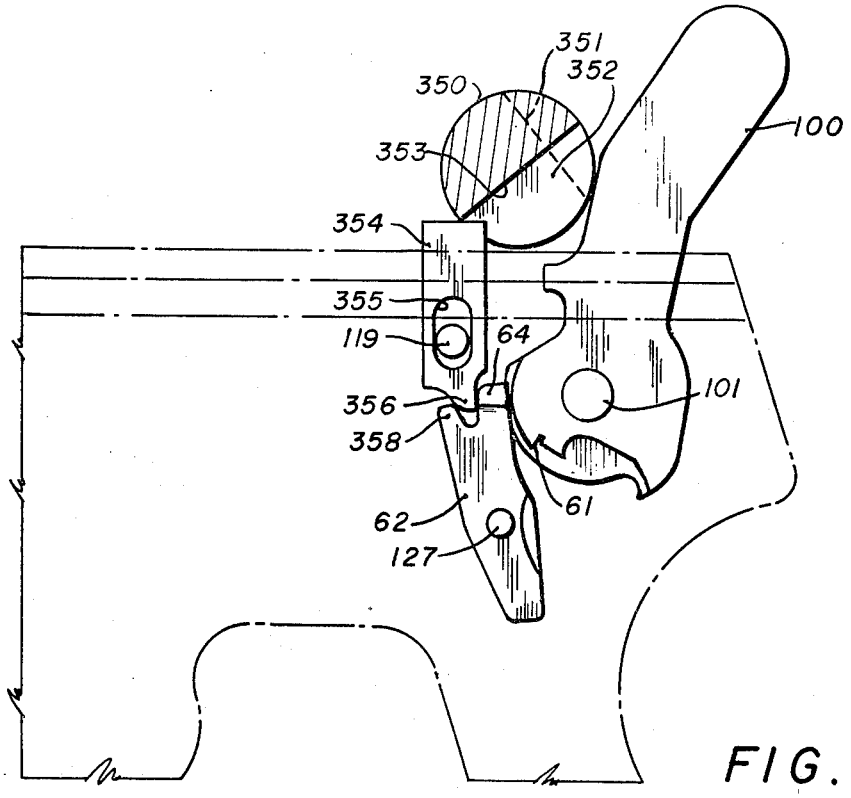
Figure 26:
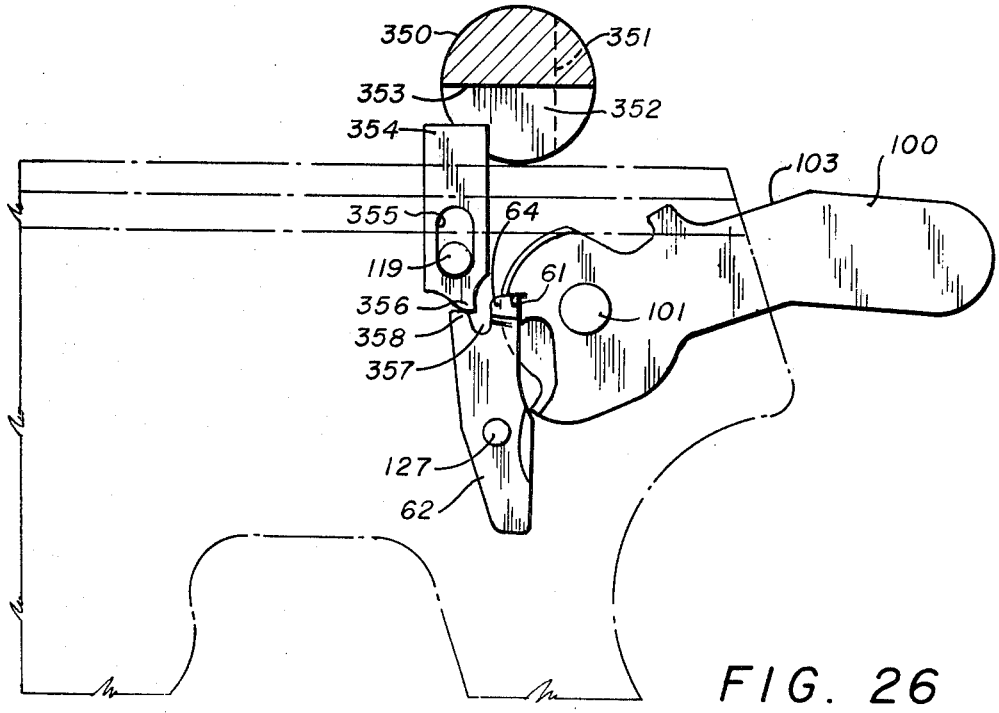
Figure 28:
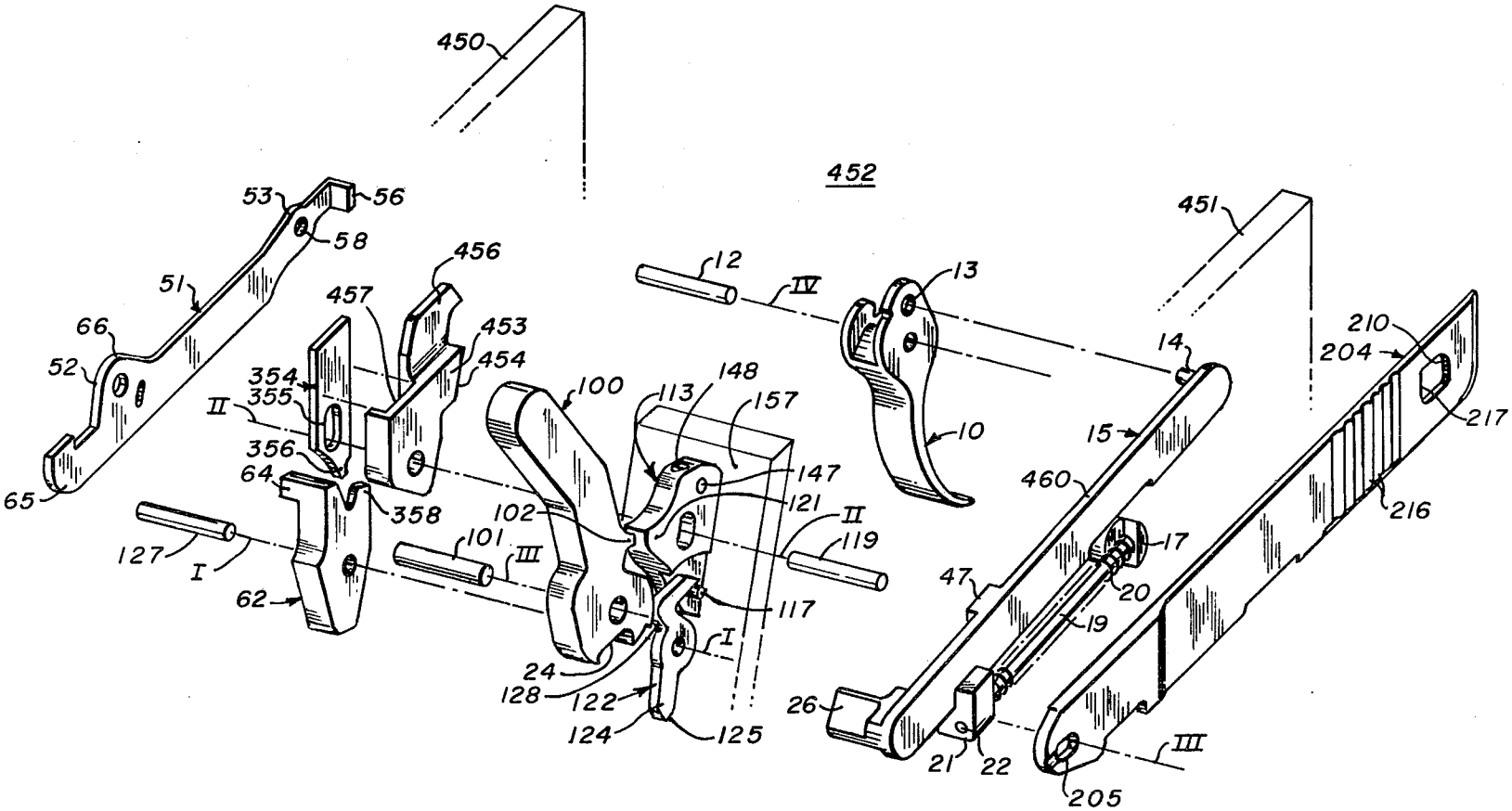

FIG. **19*a*** shows a schematic side view of the method of grinding a cylindrical front portion of the barrel;

FIG. **19*b*** shows a schematic side view of the method of grinding the front portion of the barrel to provide surfaces which are oblique with respect to longitudinal axis of the barrel;

FIG. 20 shows a left plan view of the safety mechanism for the firing pin and the hammer, the gun being in the rest position wherein forward movement of the firing pin and contacting of the firing pin by the hammer is prevented;

FIG. 21 shows a left plan view of the firing pin and hammer safety mechanism, the gun being in the position wherein the hammer has impacted the firing pin and detonated the cartridge;

FIG. 22 shows a side sectional view of the slide, the barrel and the bushing;

FIG. 23 shows a side plan view of the firing pin;

FIG. 24 shows a right side view of the gun wherein the lock bolt has been removed to expose the double action bar and to show the underside of the lock bolt;

FIG. 25 shows a left side view of the gun wherein the slide stop and the single action bar cover have been removed;

FIG. 26 shows a right side view of the manual safety of the gun, the gun being shown in the manual safety "off" position;

FIG. 27 shows a right side view of the manual safety of the gun, the gun being shown in a manual safety "on" position; and FIG. 28 shows an exploded perspective view of some of the parts of the frame assembly.

DETAILED DESCRIPTION OF THE INVENTION

Figures 1, 3, 4, 5:
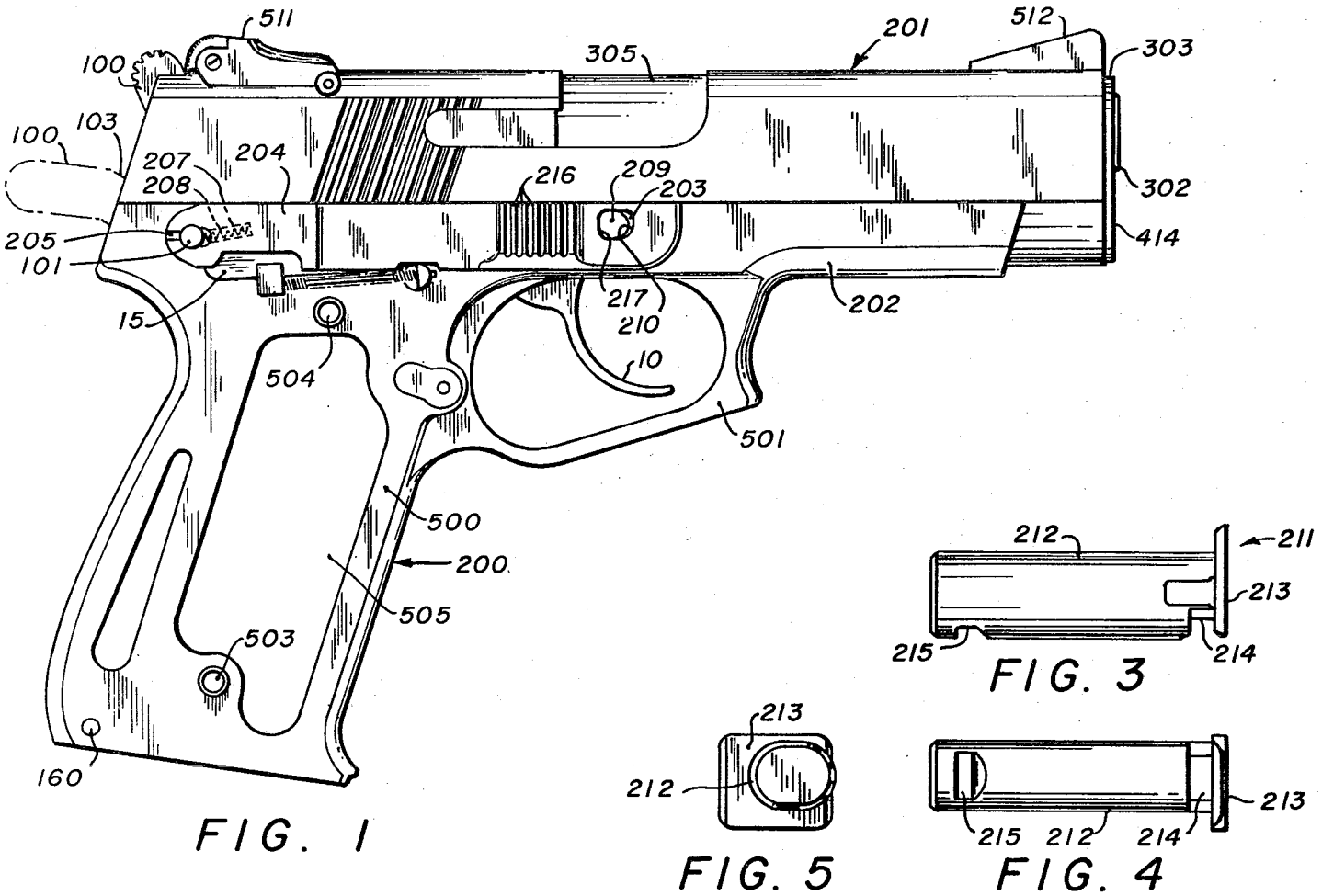
FIG. 1 shows a plan view of the right side of the gun.
FIG. 3 shows a top plan view of the take down assembly pin.
FIG. 4 shows a side plan view of the take down assembly pin.
FIG. 5 shows a plan view of the rear of the take down assembly pin.

FIG. 1 shows a right side plan view of a hand gun which includes the present invention. The take down pin has been removed and the grip parts for the handle of the gun have been removed in order to better show the various parts of the gun.

The gun is separable into two basic parts: the frame assembly 200 and the slide assembly 201. The parts associated with frame assembly 200 will be apparent from the detailed description of the invention which follows. Some of the major parts included in the frame assembly are the frame 500, the trigger 10, the hammer 100, the lock bolt 204, the single action bar 15 and the trigger guard 501.

As shown in FIG. 1 the frame 500 includes two holes 503 and 504 which allow the grip part to be secured to the gun. The grip part is a conventional part that fits over both sides of the handle of the gun. The grip part may be made of wood, plastic or other materials. Frame 500 includes a space 505 which receives a conventional magazine, the magazine not being shown in the drawings for the sake of simplicity.

Figure 2:
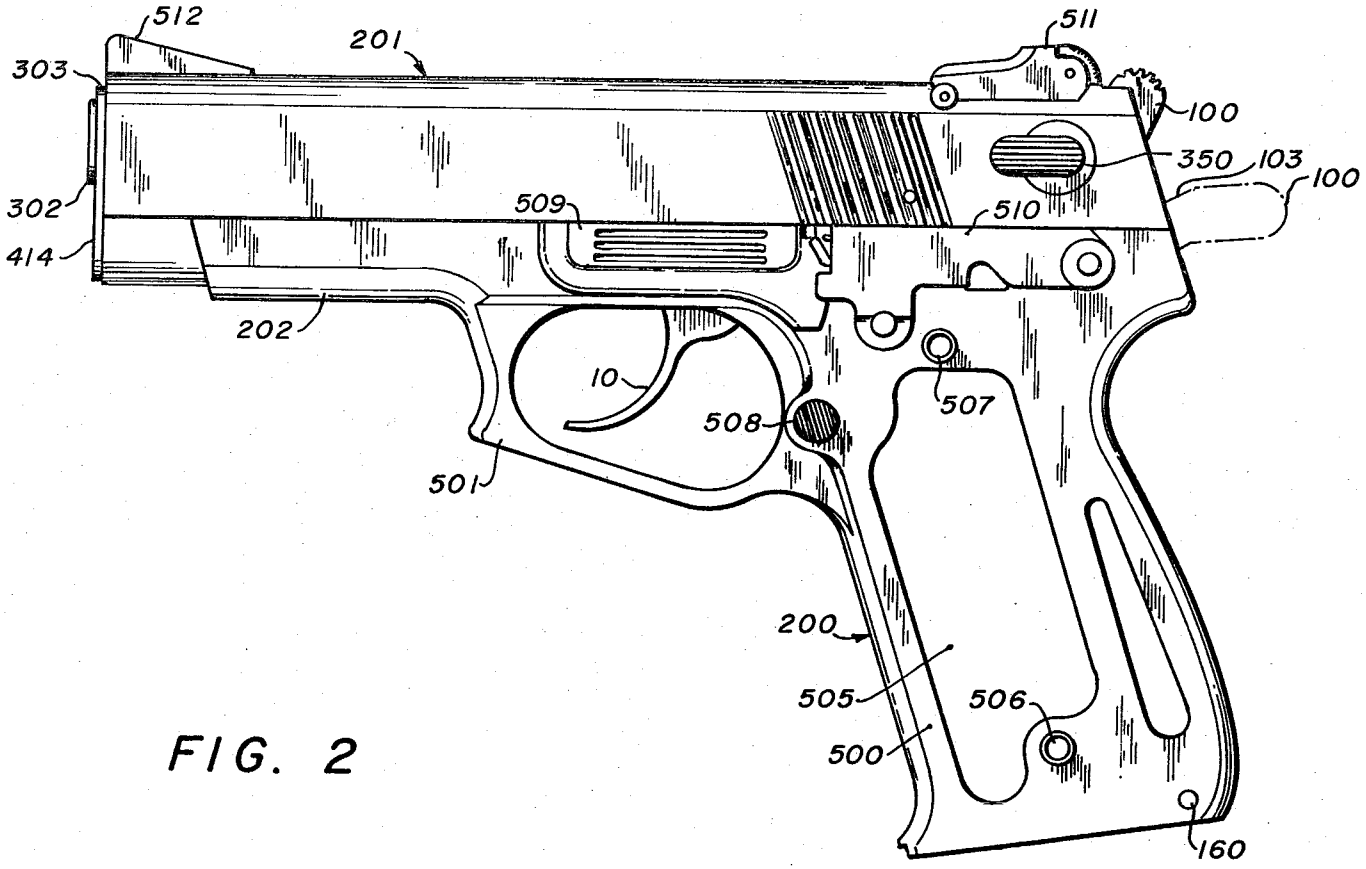
FIG. 2 shows a plan view of the left side of the gun.

The frame assembly 200 is also shown in FIG. 2. Two grip holes 506 and 507 allow for the securement of the grip part. Protruding from frame 500 is a magazine retaining button 508 which may be pushed to release the magazine from magazine accommodating space 505. The gun includes a slide stop mechanism 509 and a single action bar cover 510. The function of slide stop 509 and single action bar cover 510 will be described with respect to FIG. 30.

The parts associated with the slide assembly 201 will be apparent from the detailed description of the invention which follows. Some of the major parts included in the slide assembly 201 are slide 400 (FIG. 22), barrel 300 (FIGS. 17, 18 and 23), bushing 303, rear sight 511, front sight 512, manual safety 350, and the firing pin (not shown in either FIG. 1 or 2).

The following is a detailed description of the various mechanisms of the gun of the present invention. Each mechanism in the gun will be described by reference to only the important parts of the particular mechanism. Toward the end of the detailed description of the invention, the various parts which form the mechanisms of the gun are shown in exploded view in FIG. 28. FIG. 28 shows the spacial relation of the parts of the various mechanisms. It should be noted that a gun in accordance with the preferred embodiment of the present invention has a particularly simple construction because many of the parts of the gun perform two or more functions. It is also important to note that many of the major parts of the gun are secured within the frame of the gun by the use of four pins; i.e., pin 127, pin 119, pin 101 and pin 12 as shown in FIG. 28. The various internal parts of the gun are positioned in relation to wall 157 which is an integral part of the frame 500. FIG. 28 shows the relation of the four pins and wall 157. It may be helpful to refer to FIG. 28 while reading the following detailed description of the various mechanisms of the gun of the present invention.

FIGS. 1, 3, 4 and 5 show the take down assembly. The take down assembly allows for the slide assembly to be detachably secured to the frame assembly. FIG. 1 shows a plan view of the right side of the gun. The gun is separable into two major assemblies: the frame assembly 200 and the slide assembly 201. As described with respect to FIGS. 17 and 18, the slide assembly 201 includes a barrel 300 having a camming lug 310 extending from the slide assembly 201 into the interior of portion 202 of frame 500. Camming lug 310 includes an aperture 311 which receives take down pin 211. It should be understood that the frame includes a right side wall and a left side wall, the walls defining a space for the interior parts of the gun. The right side wall of the frame is shown at reference character 203 in FIG. 1. A generally flat elongated take down pin lock bolt 24 is slidable in relation to frame portion 202 and is biased in the forward direction as shown in FIG. 1. One end of the lock bolt includes an elongated groove 205 which allows for the lock bolt 204 to slide with respect to retaining pin 101 which is anchored in frame portion 202. A chamber 207 is machined in the interior surface of the lock bolt 204 and accommodates spring 208. Spring 208 provides a biasing force which urges lock bolt 204 in the forward position shown in FIG. 1. It should be understood that the interior surface of lock bolt 204 also has a recess which accommodates double action bar 15. This recess is not shown in FIG. 1, but, the recess is shown in FIG. 24. Wall 203 of frame portion 202 includes an aperture 209. Aperture 209 is aligned with aperture 311 in camming lug 310 of barrel 300. As shown in FIG. 1, the second end of the lock bolt 204 includes an aperture 210, the aperture 210 being out of alignment with the aperture 209 when the lock bolt is in the forward position shown in FIG. 1.

FIGS. 3, 4 and 5 show various views of take down pin 211 which may be inserted in aperture 209 of the frame and aperture 210 of the lock bolt 204. Take down pin 211 also passes through aperture 311 in the barrel camming lug 310. It should be understood that FIGS. 3, 4, and 5 are enlarged views of the take down pin that would be used with the gun shown in FIG. 1. Take down pin 211 comprises an elongated body 212. Body 212 has a generally oval cross section and is adapted to be received by apertures 209 and 210. One end of the pin 211 includes a flat cap 213 which is designed to cover aperture 210 when the pin is inserted into the gun. Adjacent cap 213, body portion 212 includes a recess 214 having one side defined by body 212 and the other side defined by cap 213. The second end of pin 211 includes a second recess 215.

In order to place pin 211 in the gun shown in FIG. 1, the finger of a person operating the gun is placed on finger gripping ridges 216 and the lock bolt 204 is slid toward the rear of the gun to a point where aperture 210 is in alignment with aperture 209. Pin 211 may then be inserted through aperture 210, aperture 209 and aperture 211 in the barrel. The interior surface of the left wall of the frame includes a recess which receives the second end of pin 211. The left wall is opposite right wall 202 and neither the left wall nor the recess is shown in FIG. 1. When lock bolt 204 is released and allowed to slide forward, edge 217 of aperture 210 engages recess 214 on pin 211. When pin 211 is received in aperture 210, aperture 209, aperture 311 and the recess in the interior surface of the left wall of the gun, the slide assembly is secured to the frame assembly.

To release the slide assembly from the frame assembly, lock bolt 204 is slid toward the rear of the gun, edge 217 disengages recess 214 and the pin 211 may be withdrawn. When pin 211 is withdrawn to a position where recess 215 is aligned with edge 217, lock bolt 204 may be released thereby allowing edge 217 of lock bolt 204 to engage recess 215 of pin 211. When the pin 211 is in the partially withdrawn position, the slide assembly may be removed from the frame assembly. The engagement of recess 215 by edge 217 retains the pin 211 and prevents loss of the pin 211 when the gun is being taken down.

Referring to FIGS. 6–11 the double action and single action systems are shown.

The double action system will be described with respect to FIGS. 6, 7, 8 and 9. Trigger 10 includes an enlongated lever 11 which is curved to provide for engagement by the finger of a person operating the gun. Trigger 10 is pivotal about pin 12 to allow for movement of the trigger between the position shown in FIG. 6 and the position shown in FIG. 9. Trigger 10 also includes an aperture 13 which receives a pin 14. Pin 14 is preferably integral with double action bar 15. Double action bar 15 has a generally elongated shape and has a length which spans the distance between the trigger 10 and the hammer 100. Double action bar 15 is pivotal about pin 14 and is biased to the rear of the gun by a spring mechanism indicated generally at 16. Spring mechanism 16 includes a pivot pin 17 mounted in frame 500. Affixed to pivot pin 17 is guide rod 19 which is attached to pin 17 and which provides for positioning of spring 20. The other end of guide rod 19 is mounted in and slidable with respect to guide spring anchor 21. Guide spring anchor 21 includes hole 22 which allows for movement of guide rod 19 therethrough. The right side of the frame assembly includes a shallow recess 49. A steel spring 48 is positioned within the shallow recess 49. One end of a spring 48 engages spring protrusion 47 on bar 15 and biases double action bar 15 upwardly. Thus, double action bar 15 is biased both upwardly and rearwardly.

Figures 6, 7, 8:
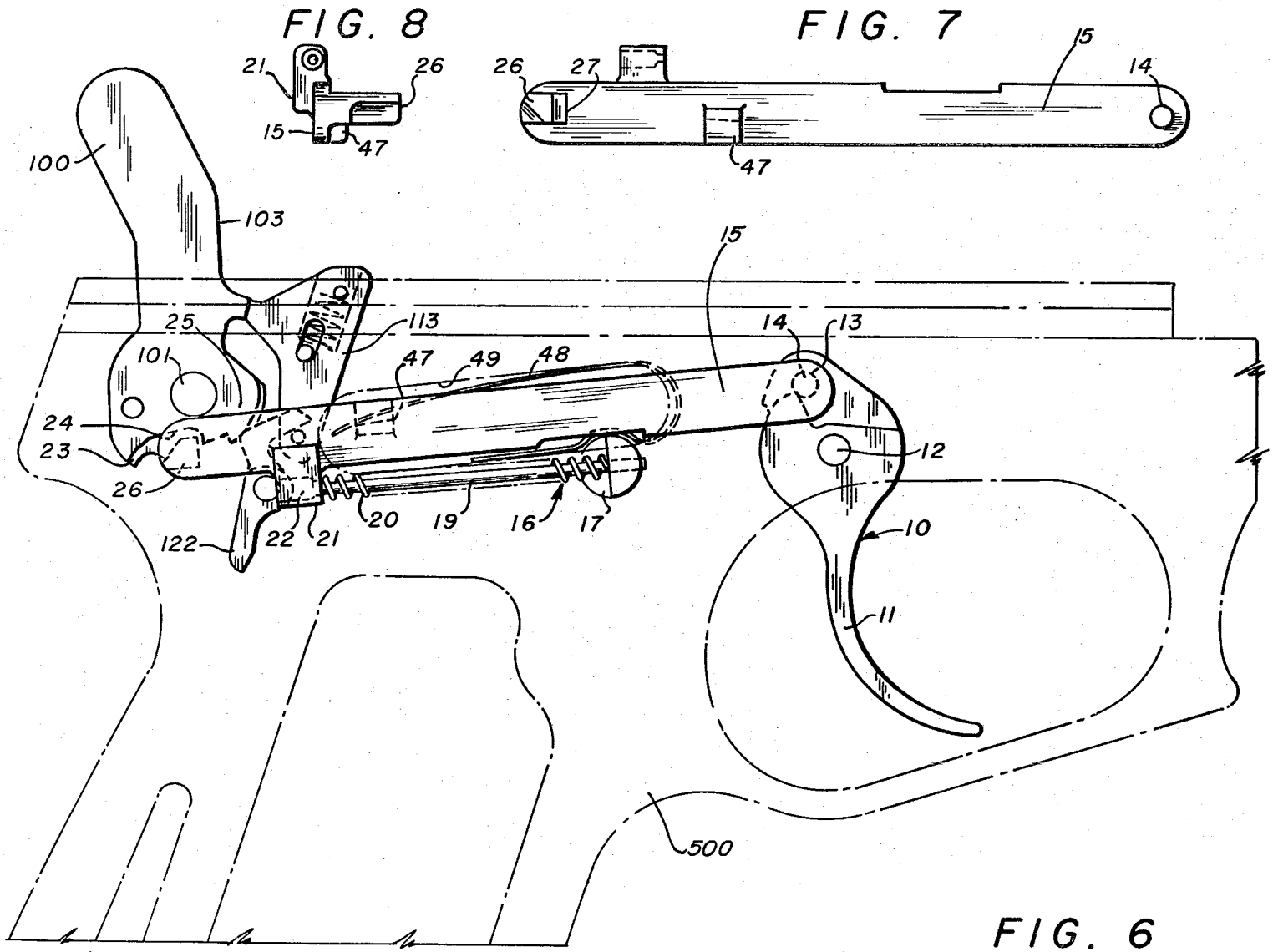
FIG. 6 shows a right side view of the double action system, the gun being in the rest position.
FIG. 7 shows a plan view of the double action bar shown in FIG. 6, the double action bar being turned over to give an unobstructed view of the interior side of the double action bar.
FIG. 8 is a rear plan view of the double action bar shown in FIG. 7.
Figure 9:
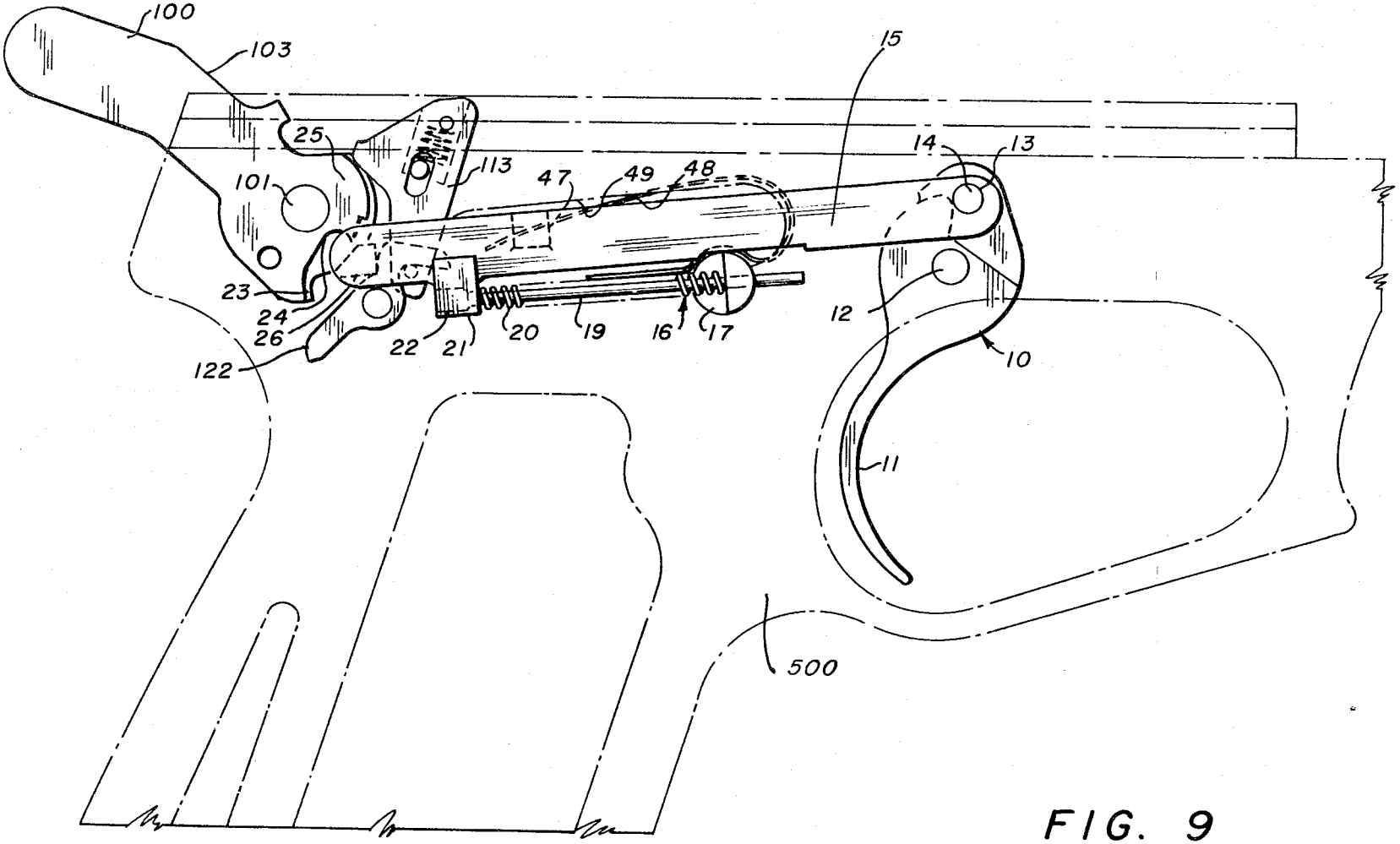
FIG. 9 shows a right side view of the double action system, the gun being in a position where the hammer is about to be released.

The end of the double action bar 15 opposite the trigger includes a mechanism for moving the hammer from the rest position shown in FIG. 6 to a withdrawn position shown in FIG. 9. The double action bar is located on the right side of the gun and adjacent the frame assembly. At its lower end, the right side of hammer 100 includes a recess 23 which defines a camming surface 24 and a camming hook 25. Cam protrusion 26 protrudes from double action bar 15 through an aperture in the frame and is designed to engage camming surface 24 in response to movement of trigger 10. Camming protusion 26 has a front surface 27 which engages the camming hook 25. Camming surface 27 also provides for movement of actuator 122 as is described with respect to FIGS. 20 and 21.

Referring to FIGS. 6 and 9 simultaneously, as the trigger is moved from the rest position toward the firing position, camming protrusion 26 engages camming surface 24 on hammer 100 and moves the hammer in the counterclockwise direction. After the hammer has been rotated a portion of the distance to the release position shown in FIG. 9, camming protrusion 26 engages and rotates actuator 122 forward to provide for the release of the firing pin and hammer safety mechanism. When the double action bar reaches the position shown in FIG. 9, camming protrusion 26 slides past camming hook 25 and the hammer is released whereupon the hammer moves forward to strike the firing pin.

Figure 10:
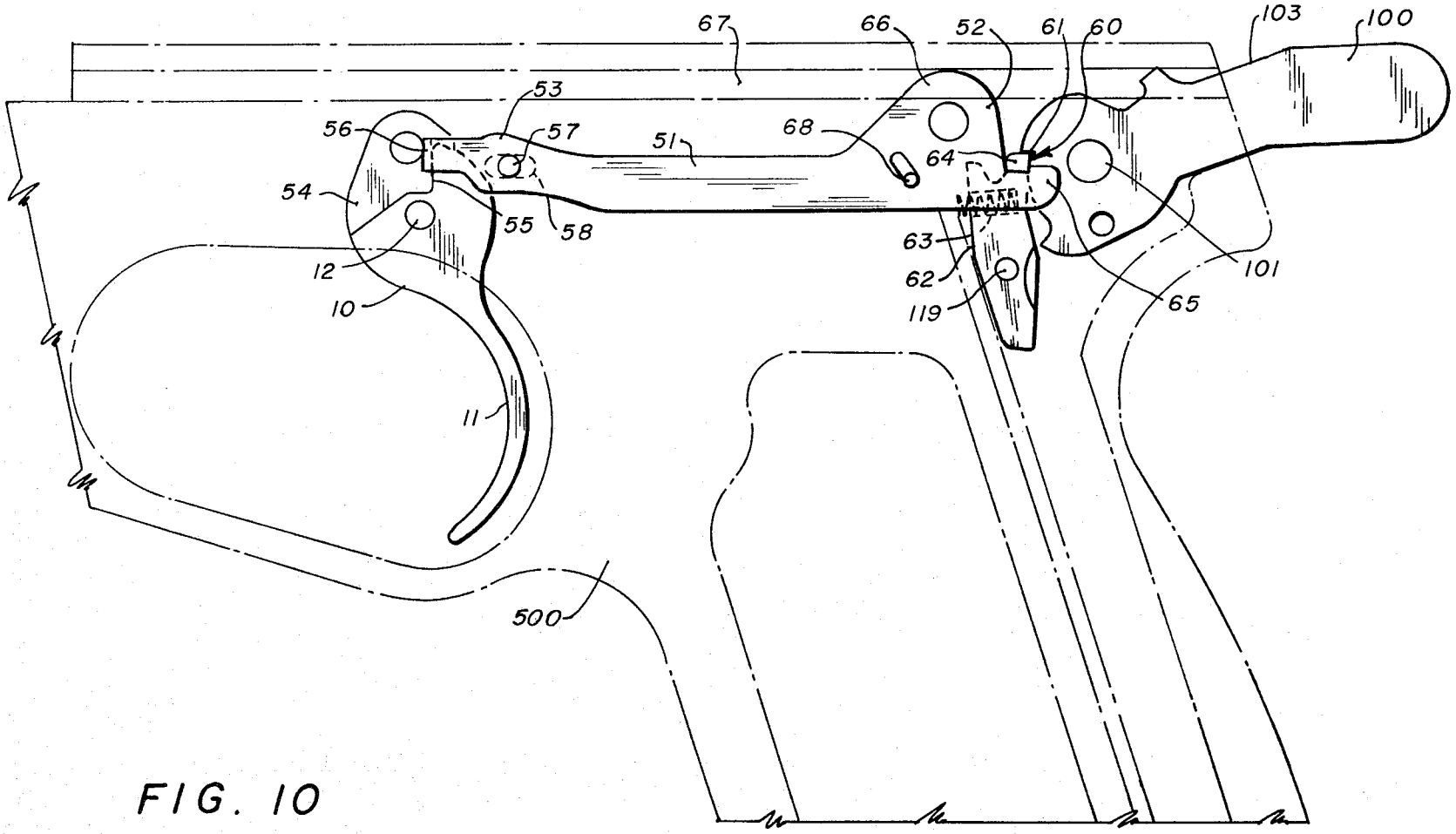
FIG. 10 shows a left side view of the single action system of the gun, the gun being in a position where the hammer of the gun is in a cocked position.
Figure 11:
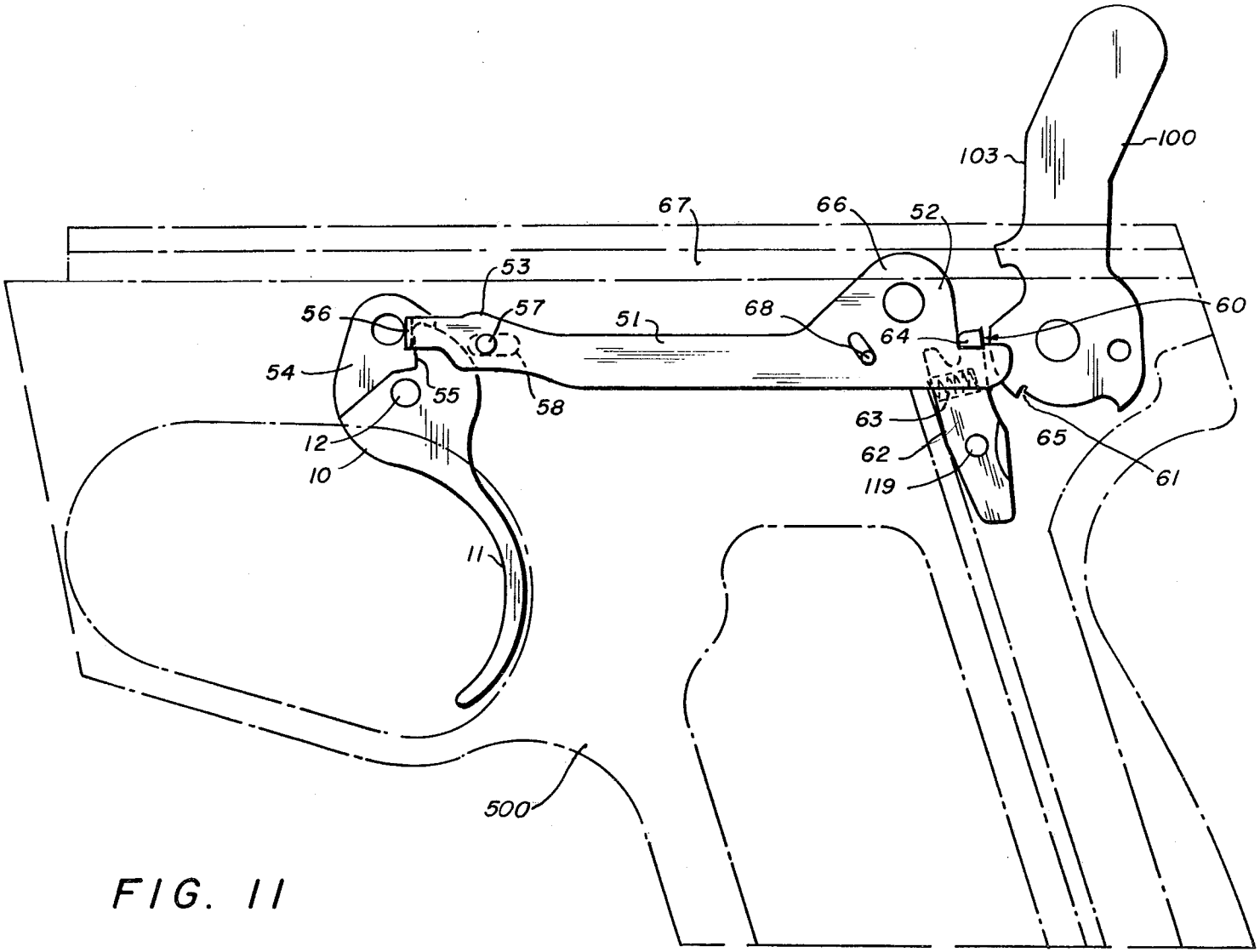
FIG. 11 shows a left side view of the single action system of the gun, the gun being shown in a position where the gun has been fired.

The detonation of the cartridge by the firing pin produces a recoiling of the slide which moves hammer 100 from contact with the firing pin and toward a cocked position wherein the gun may be fired by the single action system shown in FIGS. 10 and 11.

Referring to FIGS. 10 and 11 single action system includes as its principal component, single action bar 51. Single action bar 51 includes one end 52 which provides for release of hammer 100 and a second end 53 which is connected to trigger 10. The single action side of trigger 10 includes a recess 54 which defines a camming surface 55, camming surface 55 allowing for the trigger to move the single action bar 51 from the cocked position shown in FIG. 10 to the released position shown in FIG. 11. Single action bar 51 is positioned generally exterior to frame 500 and on a side of the frame assembly opposite double action bar 15. End 53 of single action bar 51 includes a camming protrusion 56 which extends through an aperture in the frame assembly 18 into the interior of the gun. Camming surface 55 of trigger 10 engages camming protrusion 56 to move single action bar 51 forward. Single action bar 51 is pivotal about pin 57 which is integral with bar 51 and which extends into guide cavity 58. Guide cavity 58 is an elongated slot in the frame which allows for pivoting of bar 51 about pin 57 and sliding of pin 57 with respect to frame 500.

The side of hammer 100 adjacent the single action bar 51 includes a recess 60 which provides a cocking surface 61 on hammer 100. Sear 62 comprises a generally elongated lever which is pivotally mounted on pin 119. It should be understood that pin 119 is the same pin which holds hammer safety block 113 in position. Sear 62 includes cavity 63, cavity 63 including a spring which urges sear 62 in the clockwise direction as shown in FIGS. 10 and 11. Protruding from the upper region of the sear 62 is a hammer stop abutment 64 which abuts surface 61 and prevents the hammer from falling. Abutment 64 extends through an aperture, not shown, in frame 500 and is capable of being engaged by end 52 of single action bar 51. End 52 includes a generally U-shaped hook 65 which provides for pulling of abutment 64 forward to thereby release hammer 100.

In order to release hammer 100, trigger 10 is pulled a slight additional distance. Movement of the trigger moves single action bar 51 forward a slight distance. Hook 65 of single action bar 51 engages abutment 64 and moves abutment 64 toward the front of the gun. When abutment 64 moves past surface 61 on hammer 100, the hammer is released and is allowed to fall and strike the firing pin in the position shown in FIG. 11.

It should be understood that as the single action system shown in FIGS. 10 and 11 functions, the double action system shown in FIGS. 6, 7, 8 and 9 also provides for the release of the firing pin and hammer safety mechanism. Thus, movement of trigger 10 to pull single action bar 51 forward also pulls double action bar 15 forward and provides for engagement of actuator 122 by camming surface 27 to thereby cam hammer safety block 113 downwardly.

Returning to the description in FIGS. 10 and 11, when the cartridge is detonated, the force of the detonation drives the slide toward the rear of the gun and allows for cocking of hammer 100. However, it should be understood that, to allow for cocking of hammer 100, abutment 64 must be removed from engagement with hook 65 to allow sear 62 to pivot and to allow for engagement of surface 61 by abutment 64. As the slide moves rearwardly, end 52 of the single action bar 51 is forced downwardly by the camming of the slide with slide camming abutment 66 on bar 51. The slide moves in groove 67 and forces end 52 of single action bar 51 downwardly to release abutment 64. Once the slide is returned, end 52 of bar 51 is biased upwardly to provide for engagement of abutment 64 by hook 65. Pin 68 allows for attachment of a biasing spring which urges the end 52 of single action bar 51 upwardly as shown in FIGS. 10 and 11. This can be done by a spring which is affixed to frame 18 and which is not shown in FIGS. 10 and 11. At this point, the gun is in condition for firing of an additional cartridge.

It should be appreciated that the double action bar 15 and the single action bar 51 are relatively easy to manufacture. Because of their relatively simple construction, the double action bar 15 and the single action bar 51 do not require close tolerance machining.

Figure 12:
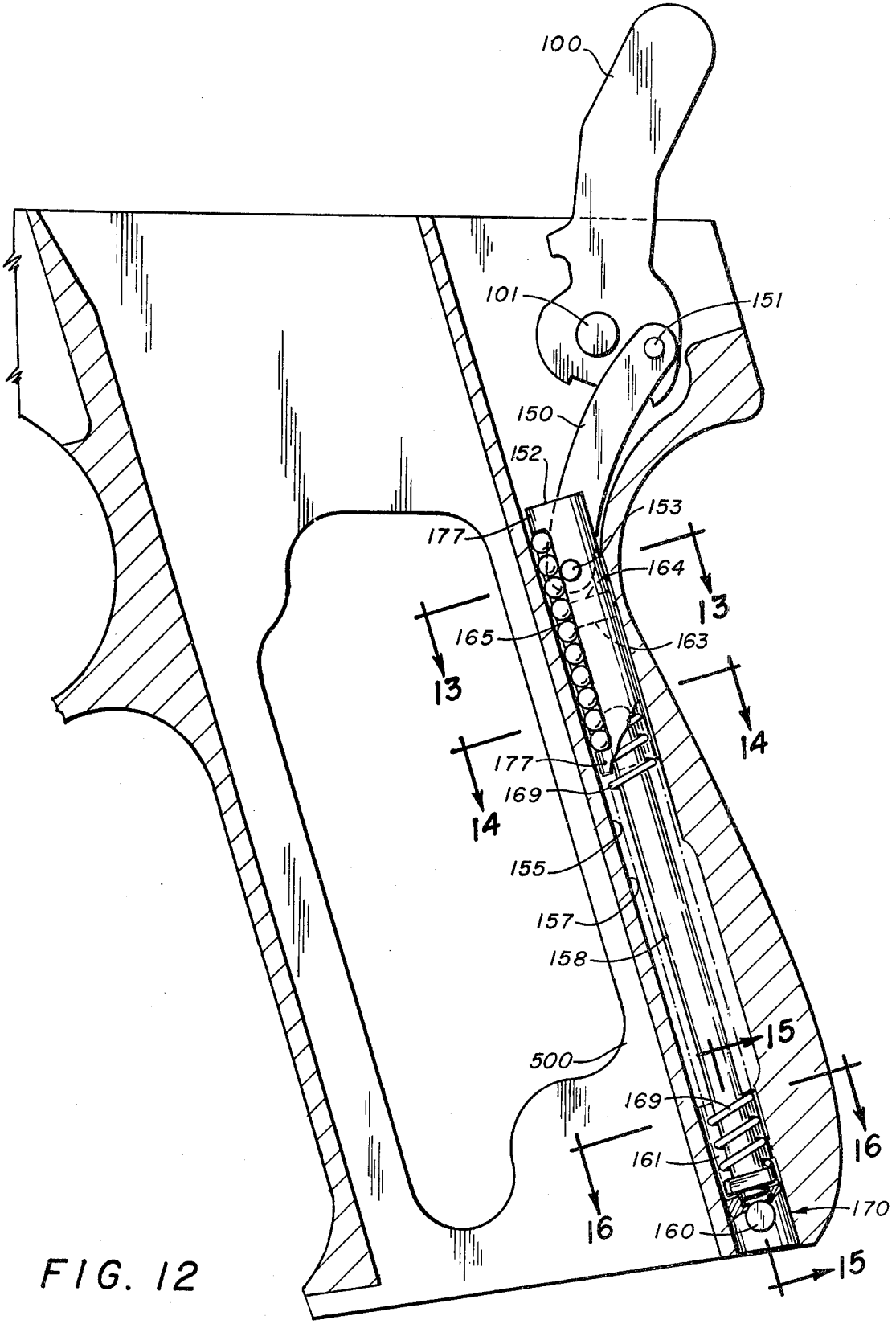
FIG. 12 shows a right side plan view of the hammer actuator mechanism.

FIGS. 12, 13, 14, 15 and 16 show a mechanism for forcing the hammer from the cocked position to a position wherein the hammer strikes the firing pin. This mechanism, commonly termed a hammer actuator, imparts rotational momentum to the hammer so that the force of the hammer is sufficient to detonate the cartridge in the gun. Referring to FIG. 12, hammer 100 is pivotal about axis 101 between a withdrawn position, that is, a cocked position, and a position where hammer 100 impacts the firing pin. FIG. 12 shows hammer 100 in a position where hammer 100 has impacted the firing pin. The force for moving hammer 100 forward is provided via connecting rod 150. One end of connecting rod is pivotal about the axis 151 of a pin mounted on hammer 100. Axis 151 is spaced from axis 101 to provide for pivotal movement of hammer 100 about axis 100 in response to the movement of connecting rod 150.

Figure 13:
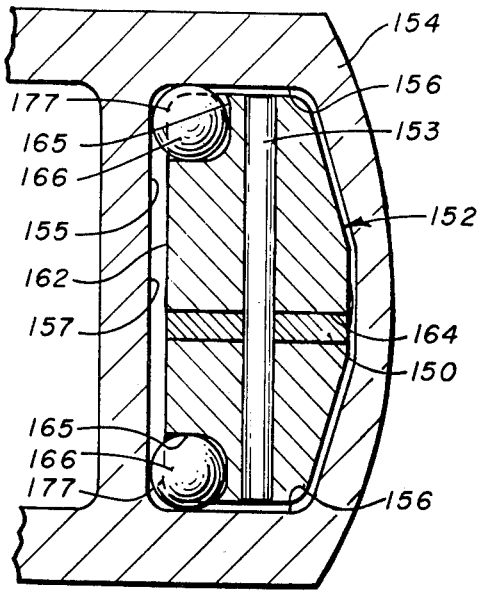
FIG. 13 shows a sectional view along the line 13—13 of FIG. 12.

Referring to FIGS. 12 and 13 simultaneously, the second end of connecting rod 150 is retained within a groove 164 in hammer actuator shoe 152. Connecting rod 150 is retained within groove 164 by connecting pin 153, connecting rod 150 being pivotal with respect to connecting pin 153. Connecting rod 150 has a curved shape and forces rotation of the hammer from the cocked position in a counter-clockwise direction to the position of the hammer shown in FIG. 12.

Figure 14:
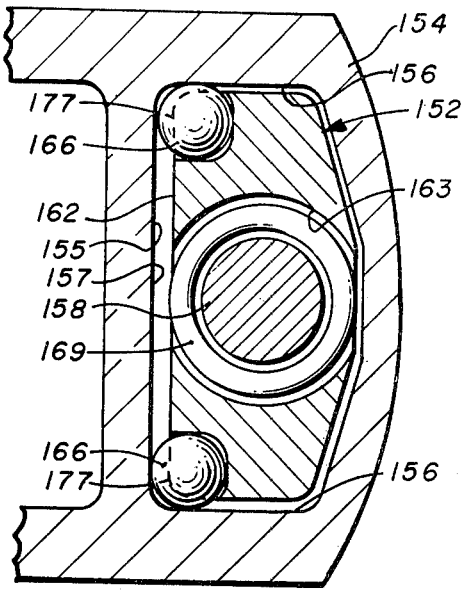
FIG. 14 shows a sectional view along the line 14—14 of FIG. 12.

Referring to FIGS. 12, 13 and 14, the frame 500 defines a generally U-shaped guide 155 having walls 156 and floor 157. Guide 155 is an integral part of the frame of the gun. Walls 156 extend at right angles with respect to wall 157. Hammer actuator shoe 152 has a generally rectangularly shaped body 162, the body being shaped and positioned within guide 155 to provide for a small clearance between body 162 and walls 156 and 157 of guide 155. Hammer actuator shoe 152 is slidable with respect to the guide 155. A particularly important aspect of the hammer actuator according to the present invention is the provision of a ball bearing mechanism which reduces the friction between hammer actuator shoe 152 and guide 155.

As shown in FIGS. 12, 13 and 14, two edges of body 162 include ball bearing retaining recesses 165. Each recess 165 receives and retains a plurality of bearing balls 166. Recesses 165 extend only a portion of the length of body 162 so that body 162 defines lower bearing retaining walls 177. Retaining walls 177 prevent bearing balls 166 from sliding out of recesses 165, but, allow for rotation of bearing balls 166. Recesses 165 have a depth less than the diameter of bearing balls 166 so that the surfaces of bearing balls 166 contact walls 156 and floor 157. As shown in FIGS. 13 and 14, the body 162 of hammer actuator shoe 152 is completely out of contact with U-shaped guide 155. Thus, the only friction surfaces are between bearing balls 166 and walls 156 and 157, and, between bearing balls 166 and bearing ball recesses 165.

The manner in which the hammer actuator shoe 152 is forced upwardly to impart forward rotation to hammer 100 will now be described. Referring to FIGS. 12, 13 and 14, one end of hammer actuator shoe 152 includes an elongated cavity 163. Guide rod 158 and spring 169 are positioned within cavity 163 and guide rod 158 is slidable with respect to cavity 163. It should be understood that cavity 163 is of sufficient depth to maintain guide rod 158 within cavity 163 during the operation of the hammer actuator mechanism. Thus, rod 158 is located within cavity 163 both in the cocked position of hammer 100 and the position wherein hammer 100 has impacted the firing pin.

Figure 15:
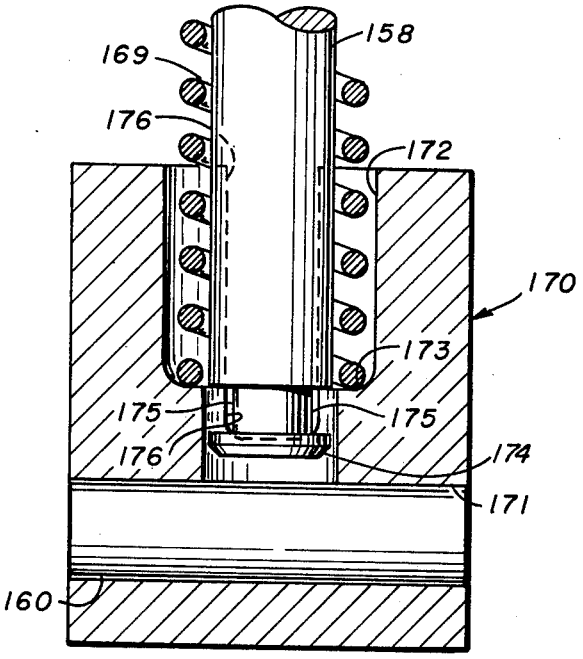
FIG. 15 shows a sectional view along the line 15—15 of FIG. 12.
Figure 16:
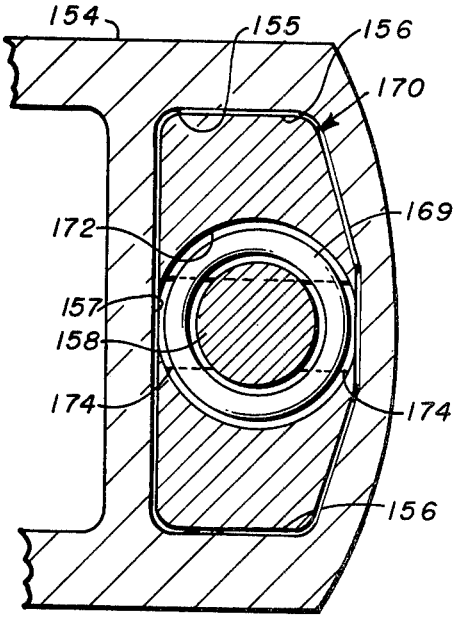
FIG. 16 shows a sectional view along the line 16—16 of FIG. 12.

Guide rod 158 and spring 169 are anchored in the lower portion of the frame. The anchor mechanism, indicated generally at 170, will be described with respect to FIGS. 12, 15 and 16. Anchor 170 has a generally rectangular cross section and fits snugly within guide 155 of the frame. One end of anchor 170 includes a transverse cylindrical hole 171 which receives pin 160. Pin 160 is mounted in frame 500 and secures anchor 170 to frame 500 of the gun. Cylindrical chamber 172 extends downwardly into the interior of anchor 170 and receives guide rod 158 and spring 169. The end of chamber 172 forms a spring retaining wall 173. Rod 158 at its lower end has a generally cylindrical shape and is crimped a small distance from the end of rod 154 to provide flange 174 which protrudes radially outwardly from the rod a greater distance than the diameter of rod 158. Flange 174 may be formed by simply clamping rod 158 between a viselike device which deforms the metal rod and provides two generally flat surfaces 175 and protruding flange 174. As shown in FIG. 15, hole 171 includes an elongated aperture 176 on both sides thereof, only one aperture 176 being shown in FIG. 15. Protruding flange 174 is received in aperture 176 whereby rod 158 is prevented from rotating within cavity 172.

As shown in FIG. 12, pin 153, which retains connecting rod 150 within groove 164, is positioned at a point intermediate the upper and lower ends of hammer actuator shoe 152. Rod 150 is biased upwardly and to the right toward the hammer 100 by spring 169. An equal and opposite force urges the hammer actuator shoe 150 towards guide 155. Thus, at any time during operation of the hammer actuator, bearing balls 166 are maintained in contact with guide 155.

In the position shown in FIG. 12, the gun has been fired and hammer 100 has impacted the firing pin. Spring 169 is compressed a relatively small amount. In order to fire the gun again, hammer 100 is withdrawn, that is, hammer 100 is rotated clockwise from the position shown in FIG. 12. Hammer actuator shoe 152 moves downwardly and spring 169 is compressed. When hammer 100 is released, the compressed spring 169 urges hammer actuator shoe 152 upwardly. The hammer is forced in a counterclockwise direction and impacts the firing pin.

The ball bearing hammer actuator of the present invention allows the hammer to fall quickly, that is, the time between the release of a hammer and the time at which the hammer impacts the firing pin is reduced. Also, when the gun is fired from the rest position, that is, a position wherein the hammer is in its upright position as shown in FIG. 12, the force necessary to pull the trigger toward the rear of the gun is reduced by the ball bearing actuator described above. Referring to FIGS. 6 and 9, in order to withdraw the hammer by use of the double action system, trigger 11 is pulled toward the rear of the gun. Hammer 100 is withdrawn from the position shown in FIG. 6 to the position shown in FIG. 9. The finger force necessary to pull trigger 11 toward the rear of the gun is reduced by the ball bearing actuator of the present invention. Because of this reduced force, the gun may be fired more accurately. Also, when the hammer is cocked manually, the ball bearing actuator of the present invention allows for cocking of the hammer with a reduced force.

Figure 17:
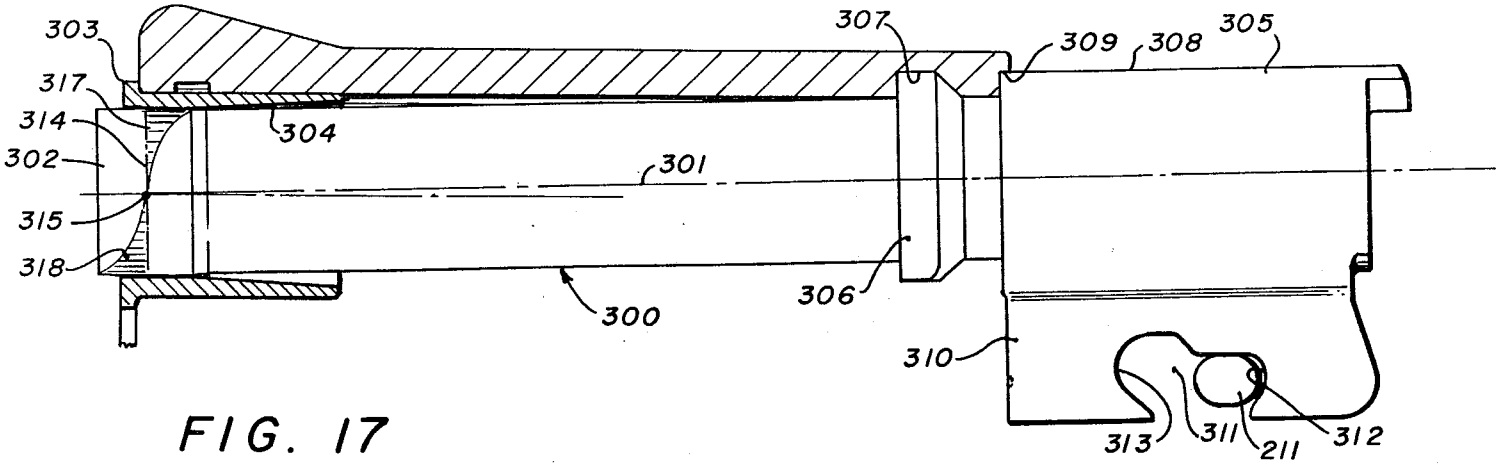
FIG. 17 shows a side sectional view of the bushing and the slide and a side plan view of the barrel disposed within the bushing and the slide, the barrel being in a firing position wherein the gun is about to be fired.
Figure 18:
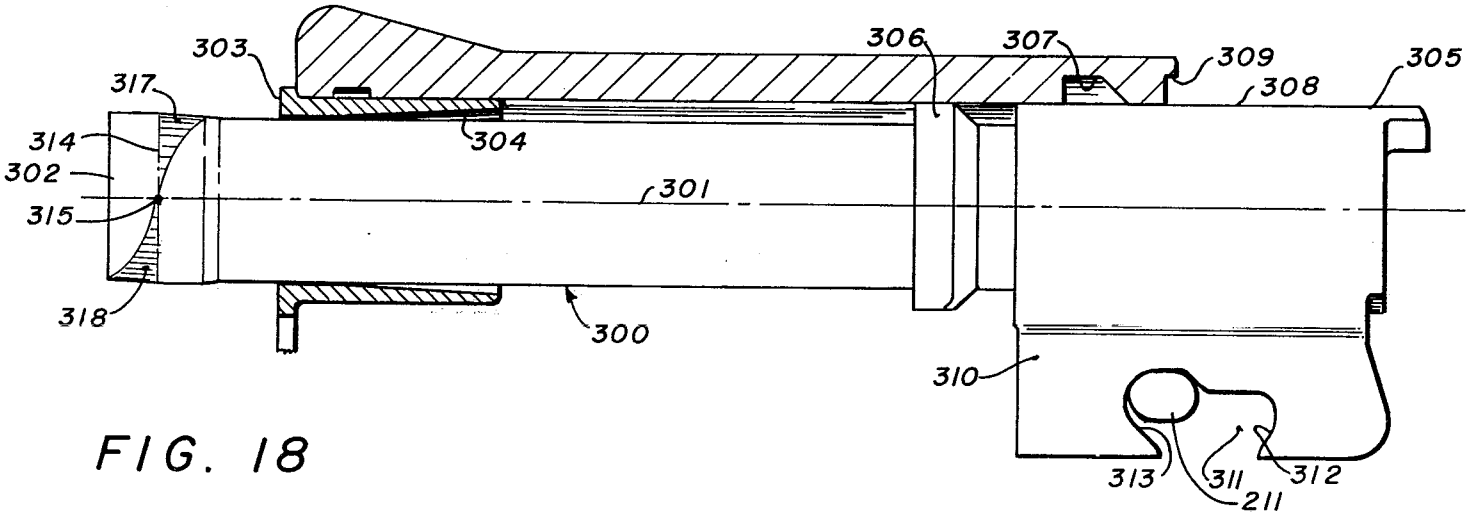
FIG. 18 shows a side sectional view of the bushing and the slide and a side plan view of the barrel, the barrel the slide and the bushing being shown in a position wherein the gun has been fired and the barrel, the bushing and the slide have recoiled.

The barrel locating structure is shown in FIGS. 17 and 18. FIG. 17 shows a side view of a barrel when the gun is in its firing position, that is, a position just prior to the detonation of a cartridge positioned within the barrel. Gun barrel 300 has a generally cylindrical shape and a longitudinal axis 301. The muzzle end 302 of barrel 300 is positioned within a bushing 303. Bushing 303 defines a cylindrical internal surface 304. The rear or chamber end 305 of the barrel includes a first lock protrusion 306 which has a generally annular shape and which extends a predetermined distance from the barrel. Lock protrusion 306 mates with a recess 307 in the slide of the gun. The rear end 305 of barrel 300 includes a second lock protrusion 308 which similarly mates with detent 309 provided on the slide of the gun. The rear end 305 of the barrel also includes a downwardly protruding camming lug 310 which includes aperture 311 defining camming surfaces 312 and 313. Takedown assembly pin 211 fits within the aperture 311 (see FIGS. 1, 3, 4 and 5 and the attendant description). Aperture 311 defines a first camming surface 312 which receives takedown assembly pin 211 when the gun is in the firing position. Aperture 311 also defines a second camming surface 313 which receives the takedown assembly pin 211 when the barrel has recoiled as shown in FIG. 18.

The particularly novel construction of the barrel locating structure of the present invention can be seen by referring to end 302 of the barrel. Axis 314 is transverse to the longitudinal axis 301 of barrel 300. The intersection of axis 301 with axis 314 defines a pivot point 315. The barrel pivots about a line which is perpendicular to both axis 301 and axis 314 and which intersects point 315. As stated earlier, the barrel 300 has a generally cylindrical shape. However, the exterior surfaces of the front end 302 of barrel 300 has been machined to provide a cross section which is no longer cylindrical.

Figure 19A:
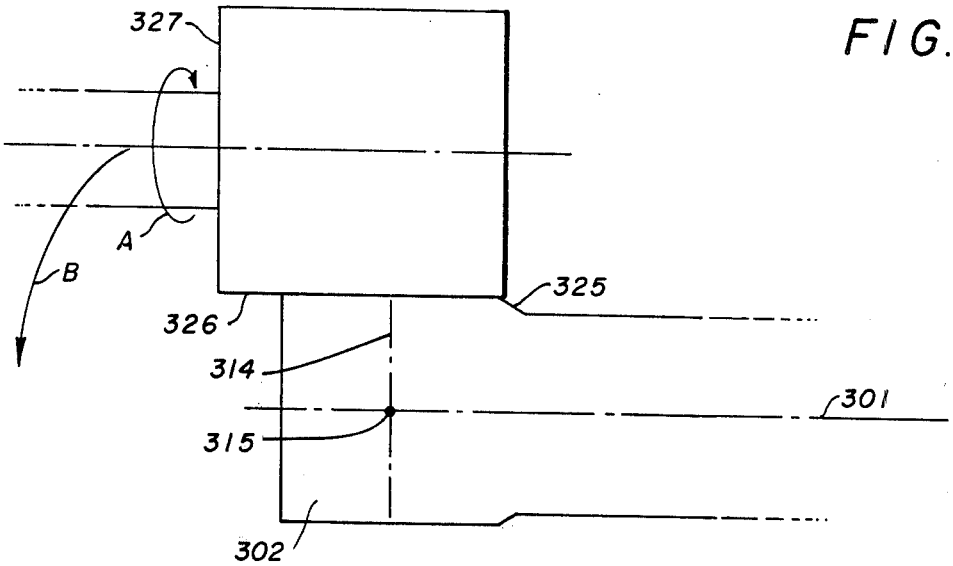
Figure 19B:
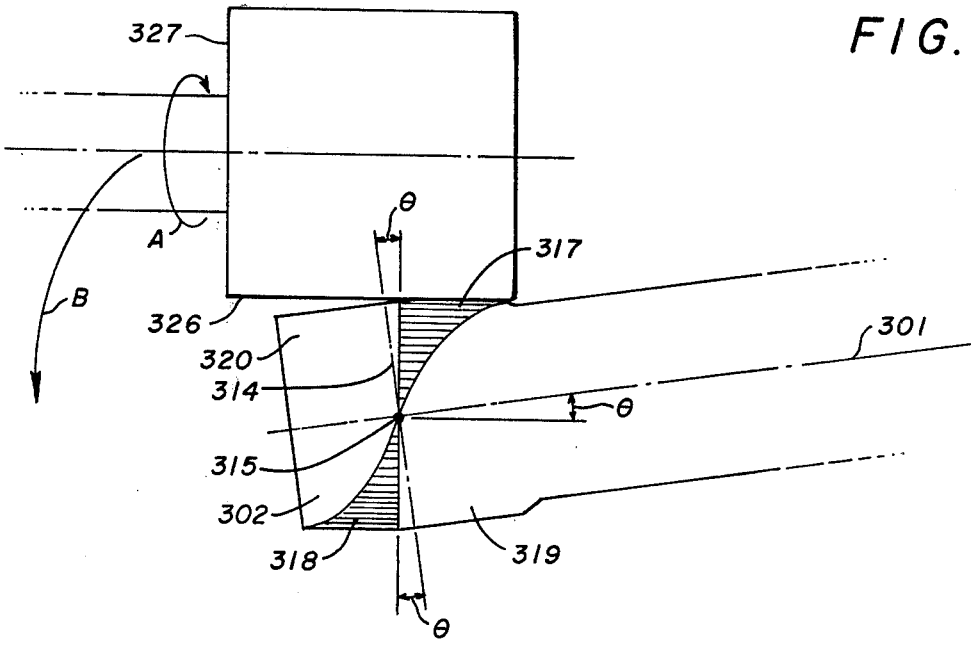

The shape of the exterior of end 302 of barrel 300 may be best understood by reference to FIGS. 19A and 19B which illustrate the method by which the barrel is made. Barrel 300 has a generally cylindrical shape and includes at one end thereof, a raised land area 325. Land area 325 has a cylindrical cross section, the cylindrical cross section preferably being provided by the grinding of land portion 325 by grinding surface 326 of tool 327. As shown on FIG. 19A, as tool 327 is rotated, grinding surface 326 contacts land area 325. Because grinding surface 326 extends in generally parallel relation to the longitudinal axis 301 of barrel 300, land surface 325 has a cylindrical shape. It should be understood that grinding surface 326 is rotated as shown by arrow A about the longitudinal axis of the grinding tool. Also, the entire grinding tool 327 is rotated as shown by arrow B about axis 301. After at least one complete rotation of the entire grinding tool, a cylindrical land surface 325 is provided. During this initial grinding the barrel remains stationary. The tool is then withdrawn to the left from the position shown in FIG. 19A.

In order to machine the exterior surface of end 302 of the barrel, the barrel 300 is tilted with respect to grinding surface 326. The barrel is tilted about a line which is perpendicular to both axis 301 and axis 314 and which intersects point 315. It should be understood that FIG. 19B grossly exaggerates the tilt of axis 301 with respect to grinding surface 326 in order to explain the method of grinding the barrel. As shown in FIG. 19*b*, the tilt angle, $\theta$ is preferably 1 degree, 3 minutes. When the longitudinal axis of the barrel has been tilted with respect to grinding tool surface 326, the grinding tool 327 is moved from the withdrawn position to the position shown in FIG. 19B. The grinding surface and the grinding tool are rotated as shown by arrows A and B to grind away a portion of land surface 325 to provide surface portions 317 and 318. Surface portions 319 and 320 remain cylindrical with respect to longitudinal axis 301. It should be understood that the portion of land area between transverse axis 314 and land areas 317 and 318 is extremely small, and when $\theta$ equals 1 degree, 3 minutes, the surface area of these portions is negligible. It is only with the exaggerated view shown in FIG. 19B that these areas appear significantly large.

The method of machining the barrel is particularly simple and provides for precision machining of the barrel. During the grinding of land area 325 as shown in FIG. 19A, and during the grinding of areas 317 and 318 as shown in FIG. 19B, the barrel 300 is stationary. Since tool 327 may be rotated about the initial location of axis 301, this rotation being indicated by arrow B, with great precision, a barrel having precise dimensions is provided.

When the gun is in the firing position as shown in FIG. 17, surface portion 317 which is angled with respect to longitudinal axis 301 of the barrel and which is positioned to the rear of transverse axis 314 engages the cylindrical interior wall of bushing 303. Surface portion 318 which is located to the front of transverse axis 314 and which is angled with respect to longitudinal axis 301 also engages the cylindrical interior wall of bushing 303. Thus in the firing position, the front end 302 of barrel 300 is firmly maintained in place by the engagement of surface portions 317 and 318 on barrel 300 with the cylindrical interior wall of bushing 303. Surface portions 319 and 320, which are cylindrical with respect to longitudinal axis 301 of barrel 300, are spaced a slight distance from the cylindrical interior wall of bushing 303.

When the gun is fired, the cartridge detonates and discharges the bullet from barrel 300. The detonation force recoils the barrel 300, the bushing 303 and the slide toward the rear of the gun. It should be understood, however, that takedown pin 211 is mounted within the frame assembly, as opposed to the slide assembly, and is stationary. Thus, as the barrel 300, bushing 303 and slide recoil toward the rear of the gun, pin 211 comes into contact with camming surface 313. At the point in time when pin 211 comes into contact with surface 313, the barrel is still engaged by the slide. That is, annular protrusion 306 is positioned within recess 307 and annular protrusion 308 is mated with detent 309. Also, surface portions 317 and 318 on barrel 300 are engaged with the cylindrical interior wall 304 of bushing 303.

When pin 211 contacts the front portion of surfaces 313, the barrel 300 can no longer recoil; i.e., is stopped from further rearward motion. Pin 211 engages camming surface 313 and forces the barrel downwardly to the position shown in FIG. 18. At this point in time, surface portions 317 and 318 have disengaged from the interior cylindrical wall of bushing 303 and surface portions 319 and 320, which are cylindrical with respect to longitudinal axis 301, become engaged with the interior cylindrical wall 304 of bushing 303. However, since the slide is not under the restraint of pin 211, the slide and bushing continue to move toward the rear of the gun. In the position shown in FIG. 18, the barrel has been moved downwardly so that the longitudinal axis 301 of barrel 300 coincides with the longitudinal axis of the cylindrical interior surface of the bushing. Axis 301 of barrel is now in a horizontal position. When barrel 300 is cammed downwardly to the horizontal position, annular protrusion 306 disengages recess 307 and protrusion 308 disengages detent 309 to allow the slide to recoil further toward the rear of the gun to a position shown in FIG. 18.

FIG. 18 shows the slide and barrel in a position subsequent to the firing of the gun. More particularly, as shown in FIG. 18, the barrel 300, the bushing 303 and the slide have fully recoiled under the detonation force of the cartridge. The rear end of barrel 300 has been cammed downwardly and out of engagement with the slide and the slide has recoiled further than the barrel.

When the slide has moved with respect to the barrel a sufficient amount for the cartridge to be ejected from the chamber, a drive spring in the slide assembly forces the barrel 300, the slide and bushing 303 forward. When the front end 302 of barrel 300 is positioned within bushing 303, the rear camming surface 312 contacts pin 211 and forces the barrel 300 to pivot upwardly to a position wherein annular protrusion 306 is located within recess 307 and annular protrusion 308 is in contact with detent 309. During the pivoting movment, surface portions 319 and 320, which are cylindrical with respect to longitudinal axis 301 of barrel 300, disengage the cylindrical interior wall of bushing 303. When the pivoting is completed, surface portions 317 and 318, which are angled with respect to the longitudinal axis 301 of barrel 300, engage the interior cylindrical wall of bushing 303. Thus, the barrel locating structure returns to the firing position shown in FIG. 17.

Referring to FIGS. 17, 18 and 19*b*, it should be understood that the magnitude of the machining angle, $\theta$, is dependent on numerous factors such as the length of the barrel and the positioning of the barrel engagement means on the interior of the slide. For a relatively long barrel, $\theta$ would be decreased and for a relatively short barrel, $\theta$ would be increased. Thus, the magnitude of $\theta$ will vary depending on the design of a particular gun.

The safety mechanism for the firing pin and the hammer will be described with respect to FIGS. 20 and 21. FIG. 20 shows the safety mechanism in the locked position wherein the safety pin is prevented from moving forward to strike the cartridge and the hammer is prevented from striking the firing pin. FIG. 21 shows the safety mechanism in the position wherein the hammer has struck the firing pin and the firing pin has moved forward to strike and detonate the cartridge.

Referring to FIGS. 20 and 21 simultaneously, hammer 100 is pivotal about first major rear axis 101. Hammer 100 includes an abutment 102 which protrudes from one side of the hammer at a portion intermediate the strike surface 103 and the pivot 101. The firing pin may be of the type described hereinafter in the application or the firing pin may be of a conventional type which includes a main body 104 and a cartridge striking pin 105. The main body or rear of the firing pin 104 includes at the bottom thereof an cut-out 106 which defines a stop surface 107. Firing pin safety lever 108 has a generally elongated shape and is pivotal at one end 109 about pin 110, pin 110 being mounted in the slide assembly of the gun. Firing pin safety lever 108 is urged or biased downwardly by spring 111. Spring 111 is positioned within a blind hole 149 in the slide. Lever 108 also includes an end portion 112 which is received by cut-out 106. Lever 108 has a flat which contacts stop surface 107 to prevent forward movement of the firing pin 104 when end portion 112 of lever 108 is engaged in cut-out 106.

Hammer safety block, indicated generally at 113, includes a generally elongated body 114 having one end defining a camming surface 115 which contacts end 112 of lever 108. The other end 116 of hammer safety block 113 includes a camming pin 117 protruding from one side thereof. Furthermore, the hammer safety block 113 includes an elongated guide hole 118 which receives pin 119. Block 113 also includes a spring retaining hole 148. Biasing spring 120 is positioned within hole 148 and between pin 119 and spring retaining pin 147. The function of spring 120 is to urge the hammer safety block 113 upwardly to thereby urge lever 108 into cut-out 106 of firing pin 104. It should be understood that spring 120 is stronger in biasing effect than spring 111, so that the force of spring 120 overcomes the force of spring 111. Protruding from the side of the hammer safety block 113 adjacent hammer 100 is an abutment 121 which prevents hammer 100 from striking the firing pin.

The mechanism for moving the hammer safety block 113 downwardly will now be described. The hammer safety block actuator or bird, indicated generally at 122, includes elongated camming surface 123 which engages camming pin 117 to provide for downward movement of hammer safety block 113. Camming surface 123 is positioned on one end of actuator 122, the other end 124 of actuator 122 providing a surface 125 which abuts a portion 126 of the frame 500 to thereby prevent rotation of the actuator 122 any further than the position shown in FIG. 20. Actuator 122 is pivotal about third major rear axis 127, axis 127 being mounted in the frame assembly of the gun.

The firing pin and hammer safety mechanism functions as follows. In the position shown in FIG. 20, the firing pin 104 and the hammer 103 are in the rest position and forward movement of the firing pin and the contacting of the firing pin 104 by hammer 100 is prevented. In order to move safety block 113 downwardly, actuator 122 must be rotated counterclockwise to the position shown in FIG. 21. This is provided for by a camming abutment on the double action bar as described above. Thus, as the trigger of the gun is pulled towards the firing position, a cam abuts actuator 122 at camming surface 128 to move the actuator 122 in a counterclockwise direction. The rotation of actuator 122 is described with respect to FIGS. 6–9.

Pin 117 is forced downwardly by actuator 122 and slides with respect to camming surface 123 to thereby move the hammer safety block 113 downwardly toward the position shown in FIG. 21. Hammer safety block 113 includes, at one side thereof, a flat surface 146. Surface 146 abuts and slides along inner wall 157 of portion 126 of frame 500. When the hammer is released by mechanisms described herein, the hammer moves forward and abutment 102 of hammer 103 moves past abutment 121 of hammer safety block 113 thereby allowing strike surface 103 to contact firing pin 104. As a result of the hammer safety block 113 being urged downwardly by actuator 122, end 112 of lever 108 is urged out of cut-out 106 by spring 111. The firing pin is now capable of moving forward in response to a strike by hammer 100.

It should be understood that wall surface 157 extends the entire height of the frame of the gun and is integral with the frame of the gun. As described with respect to FIGS. 12, 13, 14 and 15, wall 157 is the same wall that ball bearings 166 of hammer actuator shoe 152 slide with respect to.

FIG. 22 shows a sectional side view of the slide assembly. The rear portion of the slide includes an aperture 401 which receives the manual safety 350, the manual safety being shown in FIGS. 26 and 27. Slide 400 also includes an elongated firing pin chamber 402 which receives firing pin 104, a preferred embodiment of the firing pin being shown in FIG. 23. Firing pin chamber 402 also receives a firing pin spring which is not shown in the drawings but which functions to bias the firing pin 104 away from the cartridge. Immediately beneath the firing pin chamber 402 is a firing pin safety lever chamber 403 which receives firing pin safety lever 108, firing pin safety lever 108 being shown in FIGS. 20 and 21. Chamber 403 further includes a pin receiving aperture 404 which is adapted to receive pin 110 of the firing pin safety lever 108. To the right of aperture 404 is a spring retaining chamber 149, this chamber also being shown in FIGS. 20 and 21. The slide 400 also includes an elongated rail 405 which defines an elongated slide recess 406. Elongated slide recess 406 receives a slide rail 67 in the frame assembly and slide rail 67 in the frame assembly slides with respect to slide rail 405 (Slide rail 67 is shown in FIGS. 10 and 11). Immediately above slide recess 406 is hammer safety block receiving recess 407. Hammer safety block receiving recess receives the upper portion of the hammer safety block 113 when the gun is in the rest position (FIGS. 20 and 21 show the hammer safety block 113). When the gun has been fired, the hammer safety block is withdrawn from recess 407.

Slide 400 also includes a cartridge case ejection port 408 which allows for ejection of the cartridge case from a fired cartridge. Annular recess 307 and dentent 309 are also recesses shown in FIGS. 17 and 18. The front end of slide 400 includes an annular bushing receiving recess 409 which receives and retains bushing 303. More specifically, annular recess 409 receives a locking protrusion 410 which protrudes from the exterior side of the bushing. The front end 411 of bushing 303 fits within a second annular recess 412 and protrudes a short distance from the front end of slide 400. Bushing 303 includes an internal cylindrical wall 304, wall 304 being described in detail with respect to FIGS. 17 and 18. Cylindrical internal wall 304 of bushing 303 flares outwardly to form a conical lead-in portion 413 at the end thereof which is positioned inwardly with respect to the muzzle end of the barrel. It should be understood that conical wall portion 413 provides clearance for the rear portion of the barrel when the rear portion of the barrel is tilted upwardly by a small angle. Bushing 303 also includes a lower ring portion 414 which is integral with the main portion of the bushing. Ring portion 414 receives a spring guide bushing 415 which is generally cylindrical in shape and includes a bushing retaining annular wall 416. Spring guide bushing 415 defines an internal cylindrical wall 417. Spring guide rod 418 fits within bushing 415 and is slidable in relation to wall 417. Spring 419 is positioned to the exterior of bushing 415 and serves to urge spring guide rod 418 toward the rear of the gun. The second end of rod 418 includes an annular spring retaining protrusion 420 which retains spring 419. Lug portion 310 of barrel 300 provides a stop surface for end portion 420 of rod 418.

Referring simultaneously to FIG. 22 and FIGS. 17 and 18, when the gun has been fired, the detonation force of the cartridge forces slide 400 toward the rear of the frame assembly. Rail 405 slides with respect to rail 67 on the frame assembly. The detonation force which drives slide 400 toward the rear of the gun provides sufficient force to compress spring 419. As spring 419 is compressed, rod 418 is driven through bushing 415 and protrudes a predetermined distance from bushing 415. When the slide reaches the most rearward position, spring 419 is in its most compressed condition. Spring 419 urges the slide forward. As slide 400 moves forward, barrel 300 is still in a horizontal position. Slide 400 reaches a point where camming surface 421 on slide 400 abuts camming protrusion 422 on the rear portion of barrel 300. Camming surface 421 urges the barrel upwardly so that annular recess 307 and detent 309 engage the annular protrusions on the barrel. Spring 419 urges the barrel 300 and the slide 400 to the firing position shown in FIG. 17. The gun is now in a position to be fired once again.

The segmented firing pin will now be described.

Referring to FIG. 23, the firing pin 104' includes a body 36 having a generally elongated shape defining a first end 37 which is impacted by the hammer. Body 36 includes a second end 38, end 38 providing cavity 39 which has a generally cylindrical shape. The interior rear surface 49 defines an arcuately shaped seat 48. Detonation pin 41 has a generally elongated shape and has a smaller cross section than body 36. One end 42 of the detonation pin strikes the cartridge and a second end 43 of the firing pin is positioned within cavity 39. The second end of detonation pin 41 terminates in a ball 44. Ball 44 is preferably spherically shaped and seats in arcuately shaped seat 49 of cavity 39. Body 36 includes a hole 45 which is transverse to the longitudinal axis of the pin and which extends through the walls on either side of the cavity 39. Ball 44 includes an aperture which receives pin 46, pin 46 being positioned within hole 45 and retaining detonation pin 41 within cavity 39. The diameter of pin 46 is preferably smaller than the diameter of hole 45 to allow for greater machining tolerances. The front surface of pin 46 preferably contacts the front interior wall of hole 45 to reduce or prevent detonation pin 41 from sliding with respect to body 36. However, detonation pin 41 is pivotal through a small angle about pin 46.

As shown by the dashed line having double thickness, ball 44 is in contact with arcuately shaped seat 49. When end 37 of the firing pin is contacted by the hammer, the force of the hammer is transmitted to ball 44 of detonation pin 41 via seat 49. Stresses between body 36 and detonation pin 41 are accommodated by the slight pivotal movement of detonation pin 41.

FIG. 24 shows a view of the right side of the gun. Lock bolt 204 has been removed from the gun to expose double action bar 15. Furthermore, in the upper portion of FIG. 24, lock bolt 204 has been turned over to expose the under side of lock bolt 204. FIG. 24 also shows ejector 453 which is retained within the interior of the gun by pin 119. Ejector 453 includes a cartridge ejector protrusion 456 which protrudes above the frame assembly into the slide assembly. When the gun is fired and the slide moves toward the rear of the gun, ejector protrusion 456 contacts the discharge case and ejects it from the gun through aperture 408 (aperture 408 is shown in FIG. 22).

Referring simultaneously to FIGS. 28 and 24, ejector 453 includes an elongated U-shaped groove 457 which receives sear separator 354. Sear separator 354 is slidable within U-shaped groove 457. Thus, ejector 453 not only serves to eject a discharged case from the gun, but also, functions to guide sear separator 354.

Referring to FIG. 24, the interior portion of lock bolt 204 includes an elongated recess 458, recess 458 receiving double action bar 15 and providing a clearance for double action bar 15 to move within recess 458. However, recess 458 also serves as a safety lock for double action bar 15. When the lock bolt 204 is moved toward the rear of the gun, interior surface 459 of recess 458 engages the upper surface 460 of single action bar 15. Thus, when lock bolt 204 is in a position where the take down pin can be withdrawn from the gun, the gun cannot be fired by the double action mechanism because double action bar 15 is prevented from moving.

Referring to FIG. 25, a left side view of the gun is shown. Slide stop 509 is mounted on the gun for pivoting about axis 513 and includes camming surface 514. Slide stop 513 is urged downwardly by pin 515 which is mounted in a hole 516 in the single action bar cover 510. Single action bar cover 510 is secured to the frame by pin 101 and pin 518. Hole 516 housing a spring which urges pin 515 toward engagement with surface 514 on slide stop 509. Thus, in its normal position, slide stop 509 is in a horizontal position and out of engagement with slide 400. The slide stop includes a finger which protrudes through the frame wall into the magazine cavity. After the last cartridge has been fired, a conventional magazine follower engages the protruding finger of the slide stop and urges the slide upwardly. The protruding finger overcomes the spring bias on pin 515 and pivots slide stop 509 in a counterclockwise direction from the position shown in FIG. 25. When slide stop 509 is rotated upwardly, the end 517 engages a recess in the slide assembly. Thus, when the magazine is empty and the last bullet is fired from the gun, the slide does not recoil.

Referring to FIGS. 26 and 27, the manual safety for the gun of the present invention is shown. FIG. 26 shows the gun in the manual safety off position and wherein the hammer is in the cocked position. FIG. 27 shows the gun in the manual safety on position wherein the hammer contacts the manual safety and is prevented from impacting the firing pin.

Referring to FIG. 26, hammer 100 is in the cocked position wherein abutment 64 engages surface 61 of hammer 100. For a more detailed description of the cocking of the hammer and the manner by which the hammer is released, FIGS. 10 and 11 and the attendant description may be referred to. In the position shown in FIG. 26, when abutment 64 is moved out of engagement with surface 61, hammer 100 moves in a counter-clockwise direction and eventually impacts the firing pin. Manual safety block 350 includes a recess 351 which is aligned in the vertical direction and which accommodates the striking surface 103 of hammer 100 thereby allowing the striking surface 103 to impact the firing pin.

It is desirable to provide a mechanism by which the hammer 100 can be moved from the cocked position shown in FIG. 26 to a safe position wherein the hammer is no longer cocked but where the hammer is prevented from impacting the firing pin. Restated, it is desirable to be able to release the hammer from the cocked position without allowing the hammer to impact the firing pin. As shown in FIG. 26, manual safety block 350 includes a recess 352 which defines a camming surface 353.

The manual safety also includes the above-mentioned sear separator 354. The function of sear separator 354 is to move sear 62 from the position shown in FIG. 26 in a counterclockwise direction to the position shown in FIG. 27. Sear separator 354 has a generally rectangular body and is slidable in relation to pin 119. Sear separator includes an elongated guide slot 355 which receives pin 119. The lower end of sear separator 354 includes a camming nib 356. The upper region of sear 62 includes a recess 357 defining a camming lip 358. In the position shown in FIG. 26 sear separator 354 is biased upwardly and away from lip 358 and recess 357.

In order to move the hammer 100 from the cocked position shown in FIG. 26 to a safe position as shown in FIG. 27, sear separator 354 must be moved downwardly. Manual safety 350 can be rotated by means of a manual safety rotating lever 359 (lever 359 being shown in FIG. 2). From the position shown in FIG. 26, manual safety 350 is rotated in a counterclockwise direction. Before camming surface 353 contacts sear separator 354, recess 351 is rotated out of alignment with hammer 100 so that if the hammer should fall accidentally, hammer 100 will be prevented from impacting the firing pin. As manual safety 350 is rotated a small degree further, camming surface 353 engages the upper portion of sear separator 354 and overcomes the upward bias on sear separator 354. Sear separator 354 is moved downwardly to the position shown in FIG. 27. As sear separator 354 is moved downwardly, camming nib 356 engages lip 358 and forces rotation of sear 62 in a counterclockwise direction. As the sear separator 354 is moved downwardly, camming nib 356 is received by recess 357. When sear 62 has been rotated counterclockwise a sufficient distance to disengage abutment 64 with surface 61, hammer 100 falls. However, it should be understood that since recess 351 has been moved out of alignment with hammer 100, when the hammer 100 falls, it contacts manual safety 350 and is prevented from impacting the firing pin.

The manual safety may also be used to lock the gun when the gun is in the rest position. Referring to FIG. 6, the gun is shown in the rest position. In order to lock the gun, the manual safety 350 is rotated. Rotation of the manual safety will cause recess 351 to move out of alignment with hammer 100. The manual safety 350 will force the hammer to rotate a small distance in a direction away from the firing pin. Thus, as shown in FIG. 6, hammer would be rotated in a counterclockwise direction a small distance so that the abutment 102 on hammer 100 no longer contacts the abutment 121 on hammer safety block 114.

When the manual safety is in the on position as shown in FIG. 27, the gun may be unlocked by rotating manual safety 350 in a clockwise direction. Clockwise rotation of the manual safety 350 aligns recess 351 with hammer 100 and allows the hammer to rotate a slight distance in the counterclockwise direction. The hammer is prevented from impacting the firing pin because the abutment 102 on the hammer 100 is aligned and contacts the abutment 121 on the hammer safety block 114 to prevent the strike surface 103 of hammer 100 from impacting the firing pin (abutments 102 and 121 are shown in FIGS. 20, 21 and 6).

FIG. 28 shows an exploded view of some of the more important components which are mounted on the frame assembly of the preferred embodiment described herein. It should be noted that only a portion of the frame of the gun has been shown so as to provide an unobstructed view of the internal parts of the gun. The left wall 450 and the right wall 451 of the frame 500 are shown schematically. A space 452 is defined by wall 450 and wall 451, space 452 accommodating the internal parts of the gun.

In order to appreciate the simplicity of the construction of the gun of the present invention, it is important to note that the internal parts of the gun function with respect to four major axes: axis I, axis II, axis III and axis IV. Another important reference in the gun is wall 157 which extends between and is integral with left wall 450 and the right wall 451 of the frame. Wall 157 is best shown in FIG. 12.

Walls 450 and 451 include a plurality of holes which receive pins 127, 119, 101 and 12, these pins being stationary with respect to wall 450 and wall 451 (the holes in walls 450 and 451 are not shown). Pin 127 has a number of functions: pin 127 defines axis I about which sear 62 rotates. Pin 127 also functions as an axis about which hammer safety block actuator 122 rotates.

Pin 101 defines axis III about which hammer 100 rotates and also protrudes a sufficient amount from right wall 451 to provide a retaining pin for elongated hole 205 of lock bolt 204.

Pin 119 defines axis II and functions as a stop pin for sear separator 354 and as a guide pin for hammer safety block 113. Pin 119 is also a retaining pin for ejector 453.

Pin 12 defines axis IV about which trigger 10 pivots.

Wall 157 also plays an important role in locating the internal parts of the gun. Wall 157 provides a stop surface which prevents rotation of sear 62 more than a predetermined amount. Wall 157 also maintains ejector 453 in a stationary position through contact with surface 454 of the ejector. Thus, the ejector 453 is prevented from rotating about pin 119 by the contact between wall 157 and wall 454. Wall 157 also provides a slide surface for hammer safety block 113. Wall 157 further provides a stop surface for hammer safety block actuator 122. Although the hammer actuator is not shown in FIG. 28, it should be appreciated that wall 157 provides a slide surface for a ball bearings 166 of hammer actuator shoe 152. The side walls of the frame, that is, walls 450 and 451, are integral with walls 156 of U-shaped guide 155 (Refer to FIGS. 12, 13, 14, 15 and 16 for a description of the hammer actuator).

Thus, as can be appreciated from the exploded view shown in FIG. 28, the gun of the present invention is particularly simple: the important internal parts of the gun may be located by axis I, axis II, axis III and axis IV, the left wall 450, the right wall 451 and internal wall 157.

I claim:

1. In a hand gun having a frame and a slide assembly movable on said frame, the slide assembly including the barrel of the gun and a camming lug, the frame having a pair of side walls which define a space therebetween, the slide assembly camming lug extending into the space between the frame side walls, an improved means for assembling the slide assembly to the frame and disassembling the slide assembly from the frame comprising:

a pair of aligned apertures in the frame side walls;

an aperture in the slide assembly camming lug, said slide assembly being movable on said frame to align said camming lug aperture with said frame apertures;

an elongated take down pin, said take down pin having a body portion with an axis and a head at one end of said body portion, said take down pin having a cross-sectional shape and area commensurate with said aligned frame apertures, said take down pin further being provided with notches in a first side thereof adjacent the opposite ends thereof, said take down pin being of constant cross-sectional area in the region between said notches, said take down pin being inserted in said aligned frame and slide assembly camming lug apertures to attach the slide assembly to the frame;

elongated lever means mounted on a first side wall of the frame for movement in a direction generally transverse to the said take down pin axis, said lever means being engagable with said take down pin notches whereby said lever means may engage a first take down pin notch to retain the pin in position and the slide assembly mounted on the frame and may engage the other of said take down pin notches to prevent unintended separation of said take down pin from the frame when the slide assembly is removed; and means resiliently biasing said lever means toward said take down pin.

2. The apparatus of claim 1 wherein the first of said take down pin notches is adjacent the take down pin head.

3. The apparatus of claim 1 wherein the said other of said take down pin notches includes a flat wall at the side of said notch which is closest to the end of the pin and a sloped lead-in surface at the opposite side of said notch.

4. The apparatus of claim 2 wherein the said other of said take down pin notches includes a flat wall at the side of said notch which is closest to the end of the pin and a sloped lead-in surface at the opposite side of said notch.

5. The apparatus of claim 4 wherein said take down pin notches face rearwardly with respect to the muzzle of the barrel and said pin has an oval cross-section in the region between said notches.

* * * * *